US009943849B2

(12) United States Patent
Johnson et al.

(10) Patent No.: US 9,943,849 B2
(45) Date of Patent: Apr. 17, 2018

(54) SAMPLE TUBE RACKS HAVING RETENTION BARS

(71) Applicant: Abbott Laboratories, Abbott Park, IL (US)

(72) Inventors: Brett W. Johnson, Naperville, IL (US); Kenneth E. Pawlak, Vernon Hills, IL (US); Bryan K. Pawlak, Mundelein, IL (US)

(73) Assignee: Abott Laboratories, Abbot Park, IL (US)

( * ) Notice: Subject to any disclaimer, the term of this patent is extended or adjusted under 35 U.S.C. 154(b) by 0 days.

(21) Appl. No.: 14/833,910

(22) Filed: Aug. 24, 2015

(65) Prior Publication Data

US 2016/0096179 A1 Apr. 7, 2016

Related U.S. Application Data

(63) Continuation of application No. 12/872,686, filed on Aug. 31, 2010, now Pat. No. 9,144,801.

(51) Int. Cl.
*B01L 9/06* (2006.01)

(52) U.S. Cl.
CPC ..... *B01L 9/06* (2013.01); *B01L 2200/025* (2013.01); *B01L 2200/141* (2013.01); *B01L 2300/021* (2013.01); *B01L 2300/022* (2013.01)

(58) Field of Classification Search
CPC ..... B01L 2200/025; B01L 2200/141; B01L 2300/021; B01L 2300/022; B01L 9/06
See application file for complete search history.

(56) References Cited

U.S. PATENT DOCUMENTS

| | | | |
|---|---|---|---|
| 143,417 | A | 10/1873 | Munroe |
| 418,940 | A | 1/1890 | Bray |
| 1,168,535 | A | 1/1916 | Moltrum |

(Continued)

FOREIGN PATENT DOCUMENTS

| | | |
|---|---|---|
| CA | 1021962 | 12/1977 |
| CA | 2035916 | 8/1991 |

(Continued)

OTHER PUBLICATIONS

European Patent Office, "Communication pursuant to Article 94(3) EPC", issued in connection with European patent Application No. 11755487.3, dated Jun. 9, 2016, 4 pages.

(Continued)

*Primary Examiner* — Dennis White
*Assistant Examiner* — Bryan Kilpatrick
(74) *Attorney, Agent, or Firm* — Hanley, Flight & Zimmerman, LLC

(57) ABSTRACT

Sample tube racks having retention bars to retain sample tubes in the racks during processing of the contents of the sample tubes are described. An example rack for holding sample tubes includes a tube holder to hold the sample tubes in a substantially vertical orientation. A retention cover pivotally engages the tube holder at a first end and locks against the tube holder at a second end. The second end of the retention cover pivots relative to the tube holder about an axis that is non-parallel relative to a longitudinal axis of the retention cover while the first end of the retention cover is pivotally captured by the tube holder.

18 Claims, 20 Drawing Sheets

(56) References Cited

U.S. PATENT DOCUMENTS 1,634,953 A 7/1927 McCune et al.
D110,691 S 8/1938 Dudley
2,467,873 A 4/1949 Weir
2,708,037 A 5/1955 Planeta
2,741,913 A 4/1956 Dovas
2,902,170 A 9/1959 Miller
2,956,686 A 10/1960 Garey
2,979,210 A 4/1961 Patterson
3,072,362 A 1/1963 Allen
3,109,084 A 10/1963 Walsh
3,115,247 A 12/1963 Hauser
3,142,385 A 7/1964 Kahlenberg
3,175,695 A 3/1965 Goodman et al.
3,186,556 A 6/1965 Forsstrom
3,375,934 A 4/1968 Bates
3,474,913 A 10/1969 Jungner et al.
D216,491 S 1/1970 Brown
3,605,829 A 9/1971 Genese et al.
3,643,812 A 2/1972 Mander et al.
3,680,967 A 8/1972 Engelhardt
3,698,563 A 10/1972 Gordon et al.
3,744,661 A 7/1973 Fischer, Jr.
3,752,651 A * 8/1973 Bush ..... B01L 9/06 422/510
3,765,538 A 10/1973 Kowert
3,785,773 A 1/1974 Rohrbaugh
RE28,165 E 9/1974 McCormick
3,882,619 A 5/1975 Durand et al.
3,904,035 A 9/1975 Metzler et al.
3,905,482 A 9/1975 Knulst
3,905,772 A 9/1975 Hartnett et al.
3,909,203 A 9/1975 Young et al.
3,960,271 A 6/1976 Nelson
4,036,391 A 7/1977 Prodel
4,037,464 A 7/1977 Wenander
4,043,762 A 8/1977 Olds
4,055,396 A 10/1977 Meyer et al.
4,124,122 A 11/1978 Emmitt
4,160,803 A 7/1979 Potts
4,202,634 A 5/1980 Kraft et al.
4,207,289 A 6/1980 Weiss
4,265,855 A 5/1981 Mandle et al.
4,284,603 A 8/1981 Korom
4,287,155 A 9/1981 Tersteeg et al.
4,322,216 A 3/1982 Lillig et al.
D265,126 S 6/1982 Beall
4,391,780 A 7/1983 Boris
4,407,943 A 10/1983 Cole et al.
4,422,555 A 12/1983 Jacobs
4,434,890 A 3/1984 Sieck et al.
4,438,068 A 3/1984 Forrest
4,495,150 A * 1/1985 Cook ..... B01L 9/06 134/115 R
4,510,119 A 4/1985 Hevey
4,522,089 A 6/1985 Alvi
D280,130 S 8/1985 Harkins et al.
4,534,465 A 8/1985 Rothermel et al.
D286,912 S 11/1986 Andersen
4,639,135 A 1/1987 Borer et al.
D290,401 S 6/1987 Bjorkman
4,751,052 A 6/1988 Schwartz et al.
4,761,268 A 8/1988 Andersen et al.
4,787,523 A 11/1988 Kalous
4,805,772 A 2/1989 Shaw et al.
4,824,641 A 4/1989 Williams
4,849,177 A 7/1989 Jordan
4,895,650 A 1/1990 Wang
4,907,893 A 3/1990 Niemeck et al.
4,932,533 A 6/1990 Collier
4,933,147 A 6/1990 Hollar et al.
4,948,564 A 8/1990 Root et al.
4,963,493 A 10/1990 Daftsios
4,982,850 A 1/1991 Mears
5,004,103 A 4/1991 Connors et al.
5,006,066 A 4/1991 Rouse
5,029,699 A 7/1991 Insley et al.
5,057,282 A 10/1991 Linder
5,077,013 A 12/1991 Guigan
5,080,232 A 1/1992 Leoncavallo et al.
5,082,631 A 1/1992 Lenmark, Sr. et al.
5,098,663 A 3/1992 Berthold et al.
5,108,287 A 4/1992 Yee et al.
5,127,541 A 7/1992 Wakatake
5,128,105 A 7/1992 Berthold et al.
5,133,939 A 7/1992 Mahe
5,137,693 A 8/1992 Mawhirt
5,169,603 A 12/1992 Landsberger
5,173,265 A 12/1992 Golias et al.
D333,522 S 2/1993 Gianino
5,186,339 A 2/1993 Heissler
5,191,975 A 3/1993 Pezzoli et al.
D336,219 S 6/1993 Held
5,217,694 A 6/1993 Gibler et al.
5,232,669 A 8/1993 Pardinas
5,318,753 A 6/1994 Honda
5,322,668 A 6/1994 Tomasso
5,324,481 A 6/1994 Dunn et al.
5,350,564 A 9/1994 Mazza et al.
5,378,433 A 1/1995 Duckett et al.
5,456,360 A 10/1995 Griffin
5,456,882 A 10/1995 Covain
5,472,669 A 12/1995 Miki et al.
5,517,867 A 5/1996 Ely et al.
5,533,700 A 7/1996 Porter
5,571,481 A 11/1996 Powell et al.
5,576,504 A 11/1996 Evers
5,579,928 A 12/1996 Anukwuem
5,632,388 A 5/1997 Morrison et al.
5,642,816 A 7/1997 Kelly et al.
5,650,125 A 7/1997 Bosanquet
5,651,941 A 7/1997 Stark et al.
5,687,849 A 11/1997 Borenstein et al.
5,700,429 A 12/1997 Buhler et al.
5,704,495 A 1/1998 Bale et al.
5,753,186 A 5/1998 Hanley et al.
5,777,303 A 7/1998 Berney
D405,192 S 2/1999 Smith et al.
5,897,090 A 4/1999 Smith et al.
5,916,527 A 6/1999 Haswell
5,931,318 A 8/1999 Shauo
D413,677 S 9/1999 Dumitrescu et al.
D414,273 S 9/1999 Smith et al.
5,951,524 A 9/1999 Enriquez
5,959,221 A 9/1999 Boyd et al.
D417,009 S 11/1999 Boyd
5,985,219 A 11/1999 Lind
5,993,745 A 11/1999 Laska
5,996,818 A 12/1999 Boje et al.
6,015,534 A 1/2000 Atwood
D420,747 S 2/2000 Dumitrescu et al.
D421,130 S 2/2000 Cohen et al.
6,027,691 A 2/2000 Watts et al.
6,063,341 A 5/2000 Fassbind et al.
6,065,617 A 5/2000 Cohen et al.
6,123,205 A 9/2000 Dumitrescu et al.
D433,759 S 11/2000 Mathis et al.
6,156,275 A 12/2000 Dumitrescu et al.
6,190,619 B1 * 2/2001 Kilcoin ..... B01J 19/0046 422/131
6,193,064 B1 2/2001 Finneran
D439,673 S 3/2001 Brophy et al.
6,221,317 B1 4/2001 Carl
6,235,245 B1 5/2001 Sherman et al.
H1960 H 6/2001 Conrad et al.
6,251,686 B1 6/2001 Studer et al.
6,274,092 B1 8/2001 Itoh
6,335,166 B1 1/2002 Ammann et al.
6,618,981 B1 9/2003 Rodriquez
6,875,405 B1 4/2005 Mathus et al.
7,132,082 B2 11/2006 Aviles et al.
7,276,208 B2 10/2007 Sevigny et al.
7,294,308 B2 11/2007 Kacian et al.
7,611,675 B2 11/2009 Sevigny et al.
9,144,801 B2 9/2015 Johnson et al.

(56) References Cited

U.S. PATENT DOCUMENTS

| | | | | |
|---|---|---|---|---|
| 2002/0021983 | A1 | 2/2002 | Comte et al. | |
| 2002/0108917 | A1 | 8/2002 | Maruyama | |
| 2003/0017084 | A1 | 1/2003 | Dale et al. | |
| 2003/0215364 | A1 | 11/2003 | Aviles et al. | |
| 2005/0281716 | A1 | 12/2005 | Belz et al. | |
| 2007/0034592 | A1 | 2/2007 | Pavlovic et al. | |
| 2007/0054413 | A1 | 3/2007 | Aviles et al. | |
| 2008/0031776 | A1 | 2/2008 | Sevigny et al. | |
| 2008/0075634 | A1 | 3/2008 | Herchenbach et al. | |
| 2010/0288056 | A1 | 11/2010 | Clark et al. | |
| 2010/0288061 | A1* | 11/2010 | Hagen | B01L 9/06 73/864.91 |
| 2012/0051987 | A1 | 3/2012 | Johnson et al. | |

FOREIGN PATENT DOCUMENTS

| | | |
|---|---|---|
| EP | 0100663 | 2/1984 |
| EP | 0142704 | 5/1985 |
| EP | 0965385 | 12/1999 |
| EP | 1614476 | 1/2006 |
| EP | 1507594 | 8/2006 |
| EP | 1507593 | 10/2007 |
| JP | 1161164 | 6/1989 |
| JP | 07181188 | 7/1995 |
| JP | 09138235 A | 5/1997 |
| JP | 2006053129 | 2/2006 |
| JP | 2008537147 | 9/2008 |
| WO | WO9301739 | 2/1993 |
| WO | 0147640 | 7/2001 |
| WO | WO0147640 | 7/2001 |
| WO | WO03097240 | 11/2003 |
| WO | 2006113854 | 10/2006 |
| WO | WO2006113854 | 10/2006 |
| WO | WO2010132887 | 11/2010 |

OTHER PUBLICATIONS

Canadian Intellectual Property Office, "Notice of Allowance," issued in connection with Canadian Patent Application No. 2,809,267, dated Jul. 20, 2015, 1 page.

Canadian Intellectual Property Office, "Office Action," issued in connection with Canadian Patent Application No. 2,809,267, dated Feb. 24, 2015, 3 pages.

Japanese Patent Office, "Final Decision to Allowance," issued in connection with Japanese Patent Application 2013-527237, dated Dec. 22, 2014, 3 pages.

Japanese Patent Office, ""Certificate of Patent No. 5,686,899,"" issued in connection with Japanese Patent Application 2013-527237, dated Jan. 30, 2015, 2 pages.

IP Australia. "Notice of Acceptance," issued in connection with Australian Patent Application No. 2011296120, dated Aug. 20, 2014, 2 pages.

IP Australia, "Patent Examination Report No. 1 ," issued in connection with Australian Patent Application No. 2011296120, dated Aug. 23, 2013, 4 pages.

Canadian Intellectual Property Office, "Requisition by Examiner," issued in connection with Canadian Patent Application No. 2,809,267, dated Jan. 21, 2014, 3 pages.

Japanese Patent Office, "Notice of Rejection," issued in connection with Chinese Patent Application No. 2013-527237, dated Jan. 21, 2014, 4 pages.

International Bureau, "International Preliminary Report on Patentability," issued in connection with international application serial No. PCT/US2011/049815, dated Dec. 19, 2012, 44 pages.

International Preliminary Examining Authority. "Written Opinion of the International Preliminary Examining Authority," issued in connection with international application serial No. PCT/US2011/049815. dated Oct. 12, 2012, 8 pages.

International Searching Authority, "International Search Report," issued in connection with international application serial No. PCT/US2011/049815, dated Apr. 18, 2012, 11 pages.

International Searching Authority, "Written Opinion of the International Searching Authority," issued in connection with international application serial No. PCT/US2011/049815, dated Apr. 18, 2012, 12 pages.

International Searching Authority, "Invitation to Pay Additional Fees and Partial Search Report," issued in connection with international application serial No. PCT/US2011/049815, dated Jan. 26, 2012, 8 pages.

BD, "BD Viper System with XTR Technology," Brochure, published Jan. 2009, 8 pages.

Tecan Group Ltd., "Liquid Handling Robotics." © 2010, last retrieved from http://www.tecan.com/page/content/index.asp?MenuID=1&ID=2&Menu=1&Item=21.1 , Nov. 17, 2010, 1 page.

Tecan Group Ltd., "Freedom EVO Clinical." © 2010, last retrieved from http://www.tecan.com/platform/apps/product/index.asp?MenuID=1328&ID=829&Menu=1&Item=21.1.3, Nov. 17, 2010, 1 page.

Konnis. "Tecan Freedom EVO Systems for Sale," © 2009. last retrieved from http://www.konnis.com/LHFreedomEVO.html, Nov. 17, 2010, 2 pages.

"Automated Sample Preparation for Bluetongue Testing," Labnews.co.uk, last retrieved from http://www.labnews.co.uk/feature_archive.php/2547/5/automated-sample-preparation-for-bluetongue-testing , Nov. 17, 2010, 3 pages.

BD, "BD Viper with XTR Technology," Product Center, © 2010, last retrieved from http://www.bd.com/ds/productCentet/MD-Viper.asp, Nov. 17, 2010, 2 pages.

United States Patent and Trademark Office, "Requirement for Restriction/Election," issued in connection with U.S. Appl. No. 12/872,686, dated Aug. 20, 2012, 6 pages.

United States Patent and Trademark Office, "Non-Final Office Action," issued in connection with U.S. Appl. No. 12/872,686, dated Dec. 19, 2012, 39 pages.

United States Patent and Trademark Office, "Final Office Action," issued in connection with U.S. Appl. No. 12/872,686, dated Sep. 26, 2013, 15 pages.

United States Patent and Trademark Office, "Non-Final Office Action," issued in connection with U.S. Appl. No. 12/872,686, dated May 22, 2014, 32 pages.

United States Patent and Trademark Office, "Final Office Action," issued in connection with U.S. Appl. No. 12/872,686, dated Dec. 22, 2014, 18 pages.

United States Patent and Trademark Office, "Notice of Allowance," issued in connection with U.S. Appl. No. 12/872,686, dated May 18, 2015, 36 pages.

Canadian Intellectual Property Office, "Third Office action", issued in connection with Canadian patent application No. 2,809,267, dated Feb. 15, 2016, 3 pages.

European Patent Office, "Communication pursuant to Rules 16(1) and 162 EPC", issued in connection with European patent application No. 11755487.3, dated Apr. 12, 2013, 2 pages.

European Patent Office, "Extended Search Report," issued in connection with European Patent Application No. 17163231.8, dated Jul. 11, 2017, 8 pages.

* cited by examiner

SAMPLE TUBE RACKS HAVING RETENTION BARS

CROSS-REFERENCE TO RELATED APPLICATION

This patent arises from a continuation of U.S. patent application Ser. No. 12/872,686, filed Aug. 31, 2010, entitled "Sample Tube Racks Having Retention Bars," which is hereby incorporated herein in its entirety

FIELD OF THE DISCLOSURE

The present disclosure relates generally to sample tube holders and, more particularly, to sample tube racks having retention bars to retain sample tubes in the racks during processing of the contents of the sample tubes.

BACKGROUND

Automated processing of biological samples typically involves the use of sample tube racks that are adapted to hold a relatively large number of sample tubes for processing within a sample preparation or test instrument. Generally, these sample tube racks are configured to enable the sample preparation or test instrument to hold and/or convey the rack, as well as any sample tubes disposed in the rack, throughout the preparation and/or testing process(es).

Sample tubes containing biological sample material are often sealed with a cap to minimize or prevent the possibility of contamination of the samples, other nearby samples and/or exposing instrument operators processing the samples to the biological material in the samples. However, with many known automated sample processing instruments, such sample tube caps must be removed from each sample tube prior to loading a rack of such tubes in the instruments. Of course, removing the caps can result in contamination of samples and/or exposure of instrument operators to the biological material in the samples.

To eliminate the problems associated with having to remove sample tubes caps prior to processing the sample tubes, some automated sample processing instruments are configured to work with sample tubes having penetrable or pierceable caps. In these instruments, disposable pipettes may be used to pierce the sample tube caps, thereby reducing the possibility of sample contamination and/or operator exposure to biological material. While such automated instruments can eliminate significant amounts of mechanical manipulation of the samples and offer a significant improvement in contamination or exposure issues, proper retention of the sample tubes in the rack becomes an important consideration because withdrawal of the pipettes from the pierceable caps may tend to lift the sample tubes out of the rack due to the frictional forces between the caps and the pipettes.

Further, the use of pierceable caps on sample tubes can also result in pressure differentials between the contents of the sample tube and the ambient in which the caps are pierced. For example, if a sample is collected and capped at a relatively low altitude location and subsequently processed (i.e., the cap is pierced) at a higher altitude location, fluid and/or aerosols containing biological material may be expelled out the pierced opening in the cap, thereby potentially contaminating other samples and/or exposing instrument operators to the biological material.

DETAILED DESCRIPTION

Figure 1:
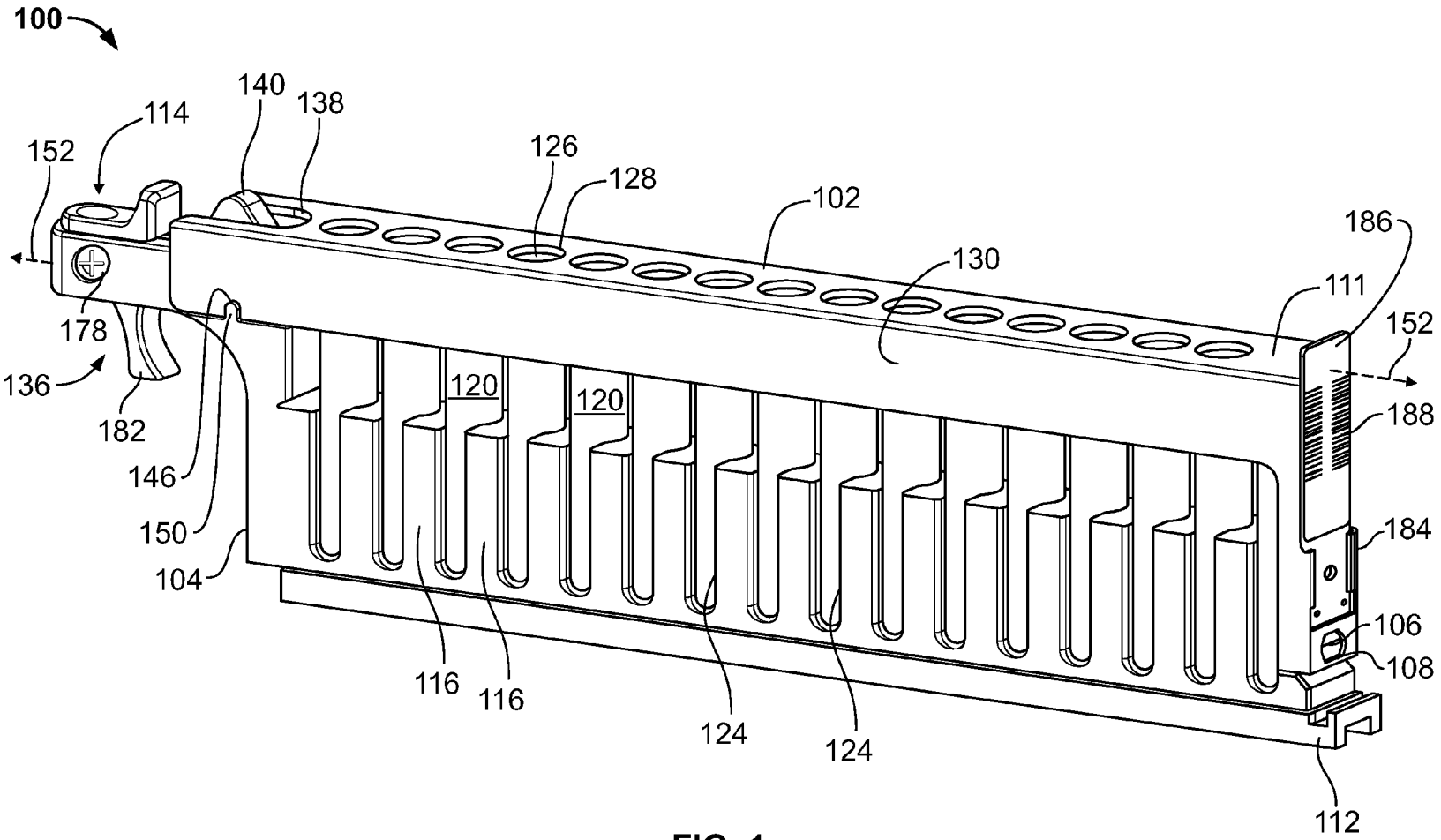
FIG. 1 illustrates an example sample tube rack having a sample tube retention bar.

The example sample tube racks described herein may be used to hold a plurality of sample tubes during automated processing of the contents of the sample tubes. The example sample tube racks advantageously employ a cover or retention bar that is configured to hold the sample tubes in a base, a sample tube holder, or a sample tube carrier during automated processing. More specifically, while the example sample tube racks described herein can be used to process sample tubes without caps, when penetrable sample tube caps are used, the retention bar prevents pipettes or the like that have pierced the caps from lifting these capped sample tubes out of the sample tube holder or carrier as the pipettes are withdrawn from the sample tubes and caps. Also, it should be recognized that while various example sample tube racks described herein may be depicted as configured to hold a particular number of sample tubes (e.g., sixteen), the teachings of the examples herein can be readily applied to sample tube racks configured to hold more or fewer sample tubes as needed to suit a particular application.

Example retention bars described herein may advantageously employ one or more features to substantially reduce or prevent contamination of samples and/or exposure of instrument operators to biological material. For example, the retention bar may be pivotally engaged to the sample tube holder to minimize or eliminate any sliding of the retention bar relative to the sample tube holder and, therefore, the tops of the sample tubes loaded in the sample tube holder. By minimizing or eliminating such sliding of the retention bar relative to the sample tube holder, the transfer of biological material from the top of one sample tube to another is substantially reduced or eliminated.

Additionally or alternatively, the example retention bars described herein may include lateral walls that form flanges to flank at least a top portion of each sample tube. These flanges can operate to control, reduce or prevent the spread of any fluids and/or aerosols, which may contain biological material(s), to other sample tubes and, more generally, within an automated processing instrument. Further, the example retention bars include openings configured to permit the passage of a pipette therethrough and into respective sample tubes positioned opposite the openings. However, these openings are sized to prevent the sample tubes from being pulled through the retention bar when pipettes that have pierced capped tubes are withdrawn from the capped tubes. To further minimize or prevent sample contamination and/or operator exposure, the openings in the retention bars may have at least two aperture sizes or cross-sectional areas. Specifically, one aperture size adjacent to a top surface of the retention bar may be sufficiently large to enable a pipette to pass through the opening, while another aperture size adjacent a bottom surface of the retention bar (and, thus, adjacent the top of a sample tube) may be relatively larger to cover or overlie a substantial portion, if not all, of a pierceable surface of a sample tube cap. In this manner, the openings may have stepped profiles that function to capture fluids or aerosols containing biological material that may escape from the sample tubes when, for example, any caps are pierced. In other words, the aperture adjacent the bottom surface of the retention bar may be made just small enough to allow the bottom surface of the retention bar to contact the periphery of the pierceable cap, preventing the cap from entering the lower aperture area while the aperture adjacent the top is relatively smaller and made just large enough to enable the passage of a pipette, thereby minimizing the aperture area through which any fluid(s) and/or aerosols containing biological material can escape to the top surface of the retention bar and sample tube rack.

Example retention bars described herein may also cooperate with the example sample tube holders described herein to facilitate loading and unloading of sample tubes, identification and tracking of the sample tubes and/or racks being processed, and/or the identification of a potential problem with the manner in which the sample tubes are loaded. For instance, in some examples, a latch or lock mechanism may be provided to lock the retention bar against the sample tube holder. Some of the example latches or lock mechanisms enable one-handed operation to facilitate loading and unloading of the sample tube rack. Further, the latches or lock mechanisms may provide visual indicators that the latch or lock is not properly or fully engaged. For instance, a color or feature may be exposed and readily visible to an operator if the latch or lock is not in a fully locked or secured condition. Similarly, the retention bar orientation or position may alternatively or additionally be used to reveal a condition in which the retention bar is not properly or fully engaged with the sample tube holder. For example, the orientation of the retention bar may be canted or angled relative to the sample tube holder when the retention bar is not fully or properly engaged with the sample tube holder. Additionally or alternatively, top portions of one or more loaded sample tubes may be exposed and visible (i.e., not covered or obscured by the flanges of the retention bar) when the retention bar is not fully or properly engaged with the sample tube holder. These exposed top portions of the sample tubes may readily indicate to an operator of an automated sample processing instrument that the retention bar is not fully or properly engaged with the sample tube holder or base and, therefore, may alert the operator to not initiate processing of the sample tubes by the instrument.

The example sample tube racks described herein may also provide identification structures to facilitate the identification of the sample tube racks and/or the sample tubes contained therein. For example, in some examples, the retention bar of a sample tube rack may include a structure to receive a tag that includes indicia identifying the sample tube rack. Such indicia or identifying information may be used, for example, by an automated sample processing instrument to detect the presence of a sample tube rack and, in some cases, whether the sample tube rack is properly loaded and ready for processing. In other words, the automated sample processing instrument may recognize the presence of such indentifying indicia as an indication of the presence of a sample tube rack having a retention bar coupled thereto and, thus, infer that the sample tube rack is loaded with sample tubes for processing.

Further, the example sample tube holders or bases described herein may also include openings or apertures to permit viewing of at least a portion of the side(s) or outer surface of each sample tube, thereby enabling manual and/or automatic reading of any indentifying information that may be provided on the sample tubes. For example, such identifying information may correspond to the source of (e.g., a person associated with) the biological sample to be processed.

Figure 2:
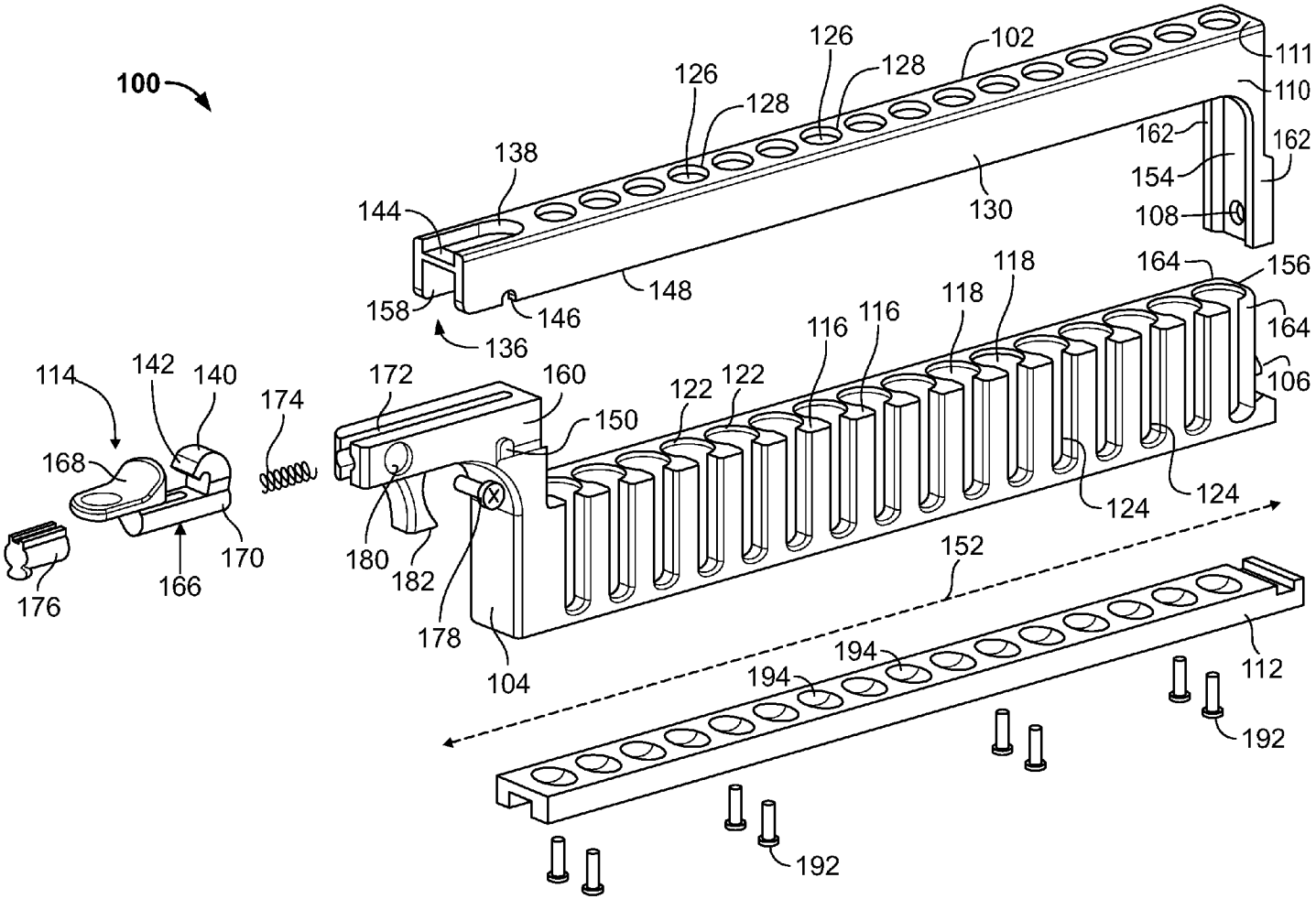
FIG. 2 is an exploded view of the example sample tube rack of FIG. 1.
Figure 3:
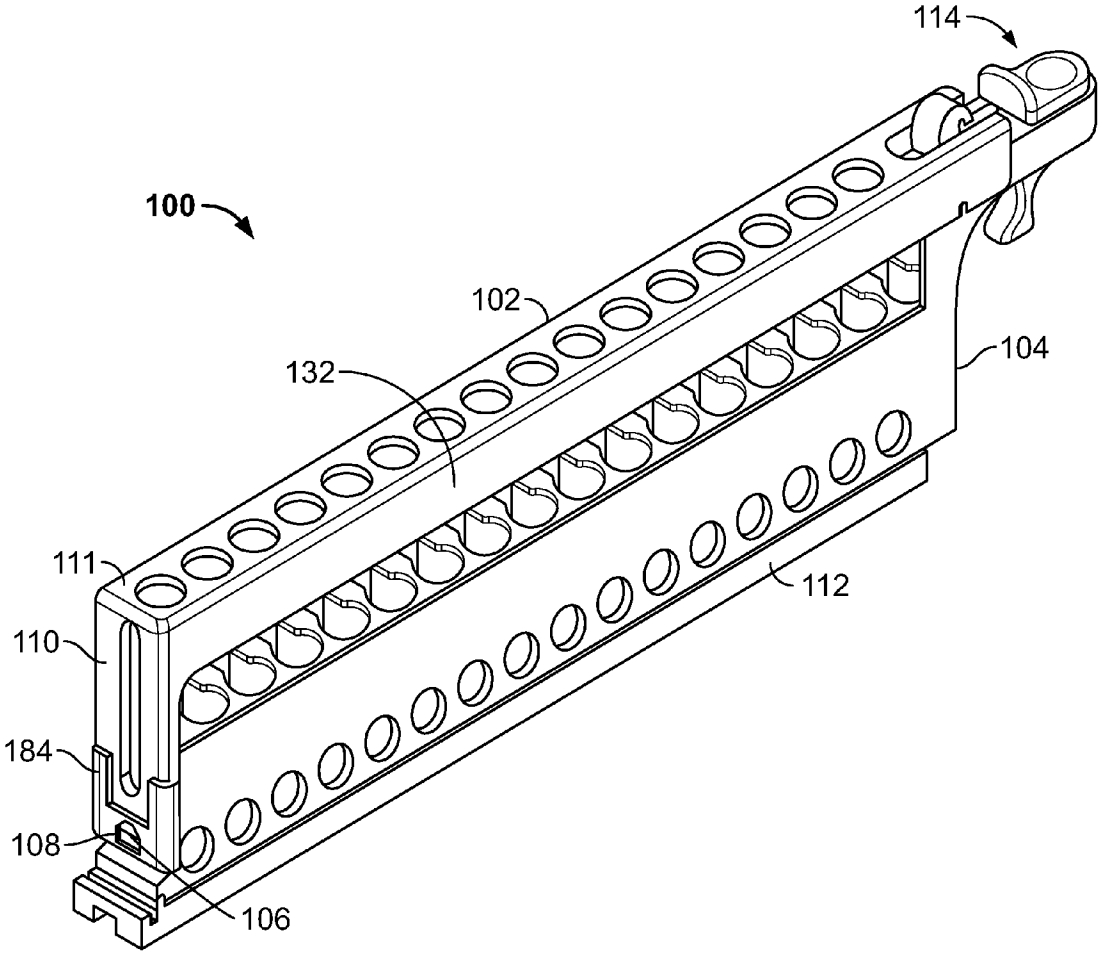
FIG. 3 illustrates another view of the sample tube rack of FIG. 1.

Now turning in detail to FIGS. 1, 2 and 3, an example sample tube rack 100 having a sample tube cover or retention bar 102 is illustrated in FIG. 1, FIG. 2 is an exploded view of the example sample tube rack 100 of FIG. 1, and FIG. 3 illustrates another view of the sample tube rack 100 of FIG. 1. The sample tube retention bar 102 is removably and pivotally coupled to a base, sample tube carrier or sample tube holder 104 via engagement of a protrusion 106 with an opening 108 of a leg 110 that extends downwardly or away from a top portion 111 of the retention bar 102. The example sample tube rack 100 also includes a guide rail 112 that is configured to interface with an automated sample processing instrument to enable the instrument to guide and/or move the sample tube rack 100 during processing. Further, the example sample tube rack 100 includes a lock or latch mechanism 114 that, as described in more detail below, may enable one-hand locking and unlocking of the retention bar 102 from the sample tube holder 104.

In the example of FIGS. 1-3, the sample tube holder 104 has an elongated body and walls 116 defining cavities or apertures 118 that are configured to receive respective sample tubes 120 and to hold the sample tubes 120 in a substantially vertical orientation during processing of the sample tubes 120 and the contents therein. The sample tubes 120 may be open (i.e., uncovered) and/or covered with, for example, a penetrable or pierceable cap. However, as can be appreciated in light the following detailed description, the features of the example sample tube rack 100 are most advantageously applied in connection with covered or capped sample tubes. As shown, the walls 116 may have curved surfaces 122 that complement the curved outer surfaces of the sample tubes 120. However, the surfaces 122 do not necessarily have to be curved and may instead be substantially flat or have any other geometry that maintains the sample tubes 120 in a suitable orientation for processing purposes.

The walls 116 define elongated openings 124, which extend along at least a portion of a length of each of the sample tubes 120 to enable viewing of any indicia or information that may be present on the outer surfaces of the sample tubes 120. Such indicia or information may be used to identify the contents and/or sources of (e.g., persons associated with) the biological samples contained in the sample tubes 120.

As noted above, the elongated retention bar 102 is removably and pivotally coupled to the sample tube holder 104 via the protrusion 106, which may include a hook-shaped feature or undercut area that extends through and engages a surface adjacent the opening 108 of the leg 110. The retention bar 102 further includes openings 126 that are positioned over respective ones of the apertures 118 of the sample tube holder 104. The openings 126 are sized to prevent removal of the sample tubes 120 through the retention bar 102. In other words, during sample processing, with the retention bar 102 properly or fully engaged with or locked to the sample tube holder 104, the sample tubes 120 are prevented from being pulled out of the sample tube holder 104 due to, for example, the frictional force(s) exerted by a pipette on a cap pierced by the pipette as the pipette is withdrawn from the sample tube and cap. The openings 126 may further include chamfers or lead-in surfaces 128 to facilitate or guide the movement of, for example, a pipette into the sample tubes 120.

The retention bar 102 further includes lateral portions or walls 130 and 132 (FIG. 3) that extend downwardly from the top portion 111 of the retention bar 102 to cover at least a top portion of each of the sample tubes 120. Thus, these lateral portions 130 and 132 form flanges that, when the retention bar 102 is properly and fully engaged with the sample tube holder 104, flank the tops of the sample tubes 120 to help prevent or at least reduce contamination due to fluids and/or aerosols containing biological material escaping from one or more of the sample tubes 120.

At an end 136 of the retention bar 102 opposite the leg 110, the top portion 111 of the retention bar 102 includes an opening 138 to receive a hook 140 of the latch mechanism 114. The opening 138 is sized to enable the body of the hook 140 to pass through the top portion 111 of the retention bar 102 when the latch mechanism 114 is held in an unlocked condition. When the latch mechanism 114 is released and, thus, allowed to springably return to a locked condition, a nose or a contoured edge 142 of the hook 140 extends over a stop surface 144 to hold the retention bar 102 in engagement or a locked condition with the sample tube holder 104 (i.e., to prevent the retention bar 102 from being pivoted away from the sample tube holder 104). As shown, the contoured edge 142 may have a beveled or tapered surface to facilitate a sliding engagement of the hook 140 with the stop surface 144.

To further facilitate alignment between the retention bar 102 and the sample tube holder 104, the retention bar 102 may also include one or more alignment notches 146 along a bottom edge 148 of the lateral portions 130 and 132. Such alignment notches 146 may engage with one or more respective complementary protrusions 150 on the sample tube holder 104. In this manner, the cooperation between the alignment notches 146 and the protrusions 150 maintains alignment of the openings 126 relative to the apertures 118 when the retention bar 102 is fully engaged and/or locked against the sample tube holder 104. In other words, these alignment notches 146 and the protrusions 150 function to align the relative positions of the retention bar 102 and the sample tube holder 104 along a longitudinal axis 152 of the sample tube rack 100. Likewise, the leg 110 includes an inner surface 154 that engages an outer surface 156 of one of the walls 116 at an end of the sample tube rack 100 to align the position of the retention bar 102 along the longitudinal axis 152 of the sample tube rack 100.

To control the lateral alignment (i.e., perpendicular to the longitudinal axis 152) of the retention bar 102 relative to the sample tube holder 104, inner surfaces 158 of the lateral portions 130 and 132 of the retention bar 102 may engage, or at least are constrained by, surfaces 160 of the sample tube holder 104 adjacent the lock mechanism 114. Similarly, the leg 110 includes lateral walls 162, which extend toward the lock mechanism 114, that engage sides or edges 164 of the wall 116 at the end of the sample tube rack 100. These lateral walls 162 limit the lateral movement of the retention bar 102 relative to the sample tube holder 104.

The latch mechanism 114 includes an actuator 166, which includes a button 168 that is coupled via a slide 170 to the hook 140. The actuator 166 slidably engages the sample tube holder 104 via a slot, channel or groove 172 and is springably biased toward a locked condition by a biasing element 174 (e.g., a spring). A plug 176, which is fixed to the sample tube holder 104 by a screw 178 that passes through an aperture 180 and into the plug 176, captures the actuator 166 in the slot 172. A finger grip 182 may be provided as shown to facilitate one-handed operation of the latch mechanism 114. For example, an operator may wrap the forefinger of one hand around the grip 182 while using their thumb of the same hand to push the button 168 against the biasing element 174 toward the unlocked condition (i.e., toward the leg 110). Although not shown, the channel or groove 172 may include one or more weep or drain holes to permit any liquid that may enter the channel or groove 172 (e.g., during cleaning of the sample tube rack 100) to pass through the rack 100.

Figure 4:
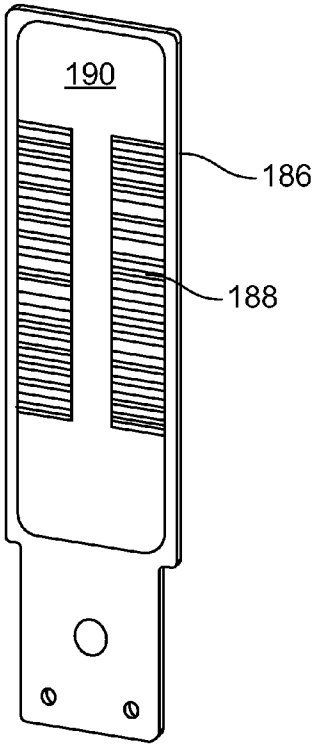
FIG. 4 is a more detailed view of the sample tube rack identification tag of FIG. 1.

In the example of FIG. 1, the leg 110 of the sample tube rack 100 includes a slot or recess 184 to receive a tag 186 containing indicia or information 188 identifying the sample tube rack 100 and/or the sample tubes 120. Turning briefly to FIG. 4, a more detailed illustration of the tag 186 is provided. As shown in FIG. 4, the tag 186 may have a substantially rectangular body, which may be made of a corrosion resistant metal (e.g., stainless steel) or any other suitable material (e.g., a plastic material), on which an adhesive-backed label 190 has been applied. The information or indicia 188 may be printed or otherwise applied to the label (e.g., before the label 190 is applied to the tag 186), or the information or indicia 188 may be applied directly to tag 186. The information or indicia 188 may take the form of barcode, text, numerical data, or any other form. However, the use of barcode is particularly advantageous when the sample tube rack 100 is used with an automated sample processing instrument because such barcode can be automatically read and interpreted by such an instrument.

Returning to FIGS. 1-3, the sample tube rack 100 also includes the rail 112 to facilitate use of the sample tube rack 100 with one or more different sample processing instruments. The rail 112 may be specifically adapted to work with a particular sample processing instrument or may be adapted to work with a number of different sample processing instruments. The rail 112 is depicted as a separate piece that is coupled to the bottom of the sample tube holder 104 via fasteners 192 (e.g., screws). However, the rail 112 may, alternatively, be integrally formed with the sample tube holder 104. The example rail 112 also includes openings 194 to enable any liquid(s) that may be present in the sample tube rack 100 to pass through the bottom of the sample tube rack 100.

The various components of the example sample tube rack 100 may be made of identical, similar and/or different materials to suit the needs of particular applications. In some examples, the retention bar 102 and the sample tube holder 104 are made of plastic while the guide rail 112 is made of metal. Such a material selection provides a rugged rail, which can be replaced as needed due to wear or changed to enable adaptation of the sample tube rack 100 to different processing instruments. Further, the use of lighter, plastic materials for the retention bar 102 and the sample tube holder 104 while metal is used for the guide rail 112 provides a relatively lower center of mass and, thus, increased stability of the rack 100, particularly when the rack 100 is loaded with the sample tubes 120. However, in other applications, the guide rail 112 may be made of plastic rather than metal. Further, the various components (e.g., a surface of the sample tube holder 104) may be flame treated to facilitate adhesion of a label to the component.

Figure 5:
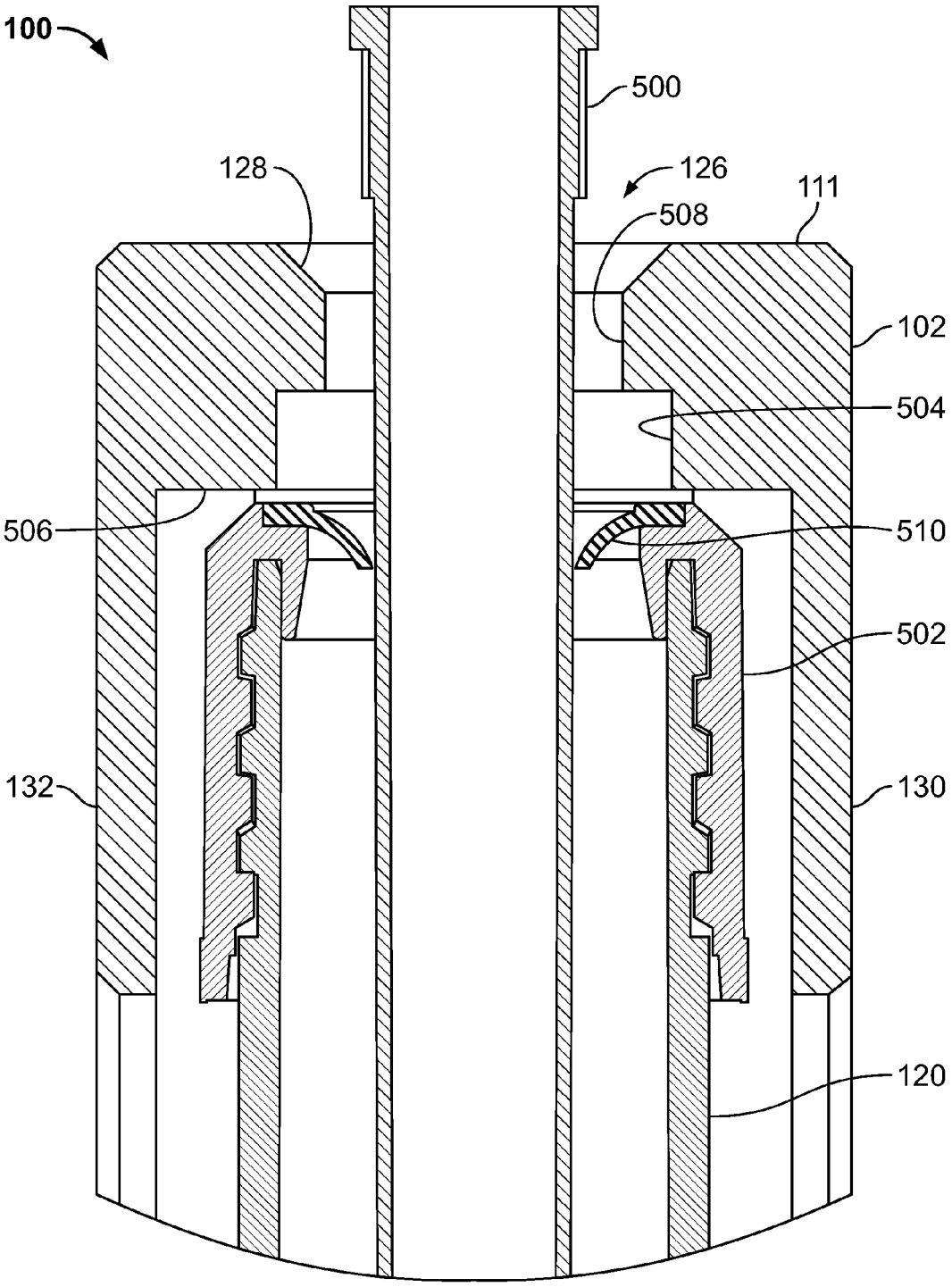
FIG. 5 is an enlarged cross-sectional view of a portion of the sample tube rack of FIG. 1 showing a pipette penetrating a cap through a stepped-profile opening in the retention bar.

FIG. 5 is an enlarged cross-sectional view of a portion of the sample tube rack 100 of FIG. 1 showing a pipette 500 penetrating a cap 502 through one of the openings 126 in the retention bar 102. As depicted in FIG. 5, each of the openings 126 has a stepped profile that functions to reduce or avoid contamination due to fluid(s) and/or aerosols escaping from one or more of the sample tubes 120. More specifically, the stepped profile may be composed of at least two different aperture sizes. For example a lower aperture 504 adjacent a bottom surface 506 of the retention bar 102 is relatively larger (e.g., has a larger diameter, cross-sectional area, etc.) than another, upper aperture 508 that is adjacent the top portion 111 of the retention bar 102. In this example, the upper aperture 508 is sized to be only sufficiently large enough to enable passage of the pipette 500 through the retention bar 102, whereas the lower aperture 504 is relatively larger and substantially overlies or covers a pierceable portion 510 of the sample tube cap 502. Such an arrangement of aperture sizes enables the lower aperture 504 to be sufficiently large to facilitate the capture of any fluids and/or aerosols that may escape from the sample tube 120 when the pipette 500 pierces the cap 502 while the relatively smaller upper aperture 508 substantially reduces or restricts the area or path through which any such escaped fluids or aerosols may pass to the ambient and/or other sample tubes 120.

Figure 6:
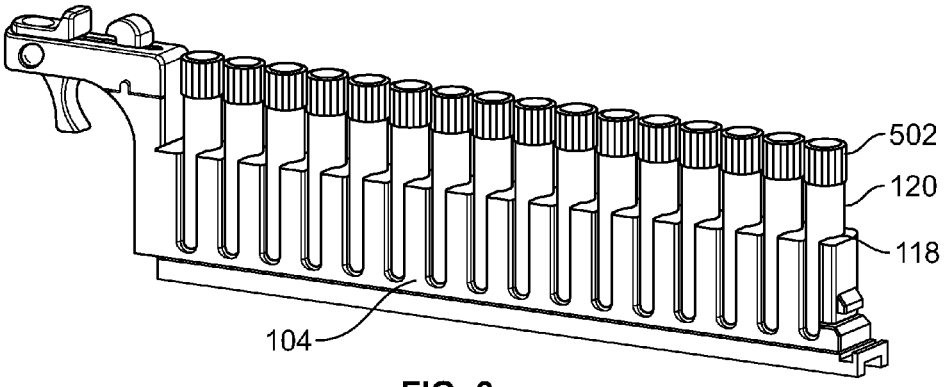
FIG. 6 shows the example sample tube rack of FIG. 1 with the retention bar removed.
Figure 7:
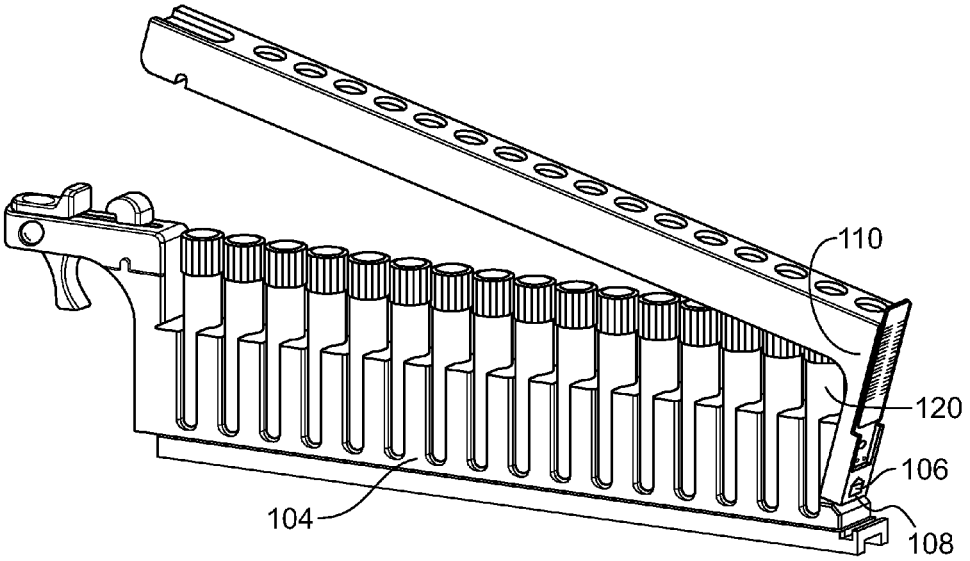
FIG. 7 shows the example sample tube rack of FIG. 1 with the retention bar pivotally engaging the sample tube holder.
Figure 8:
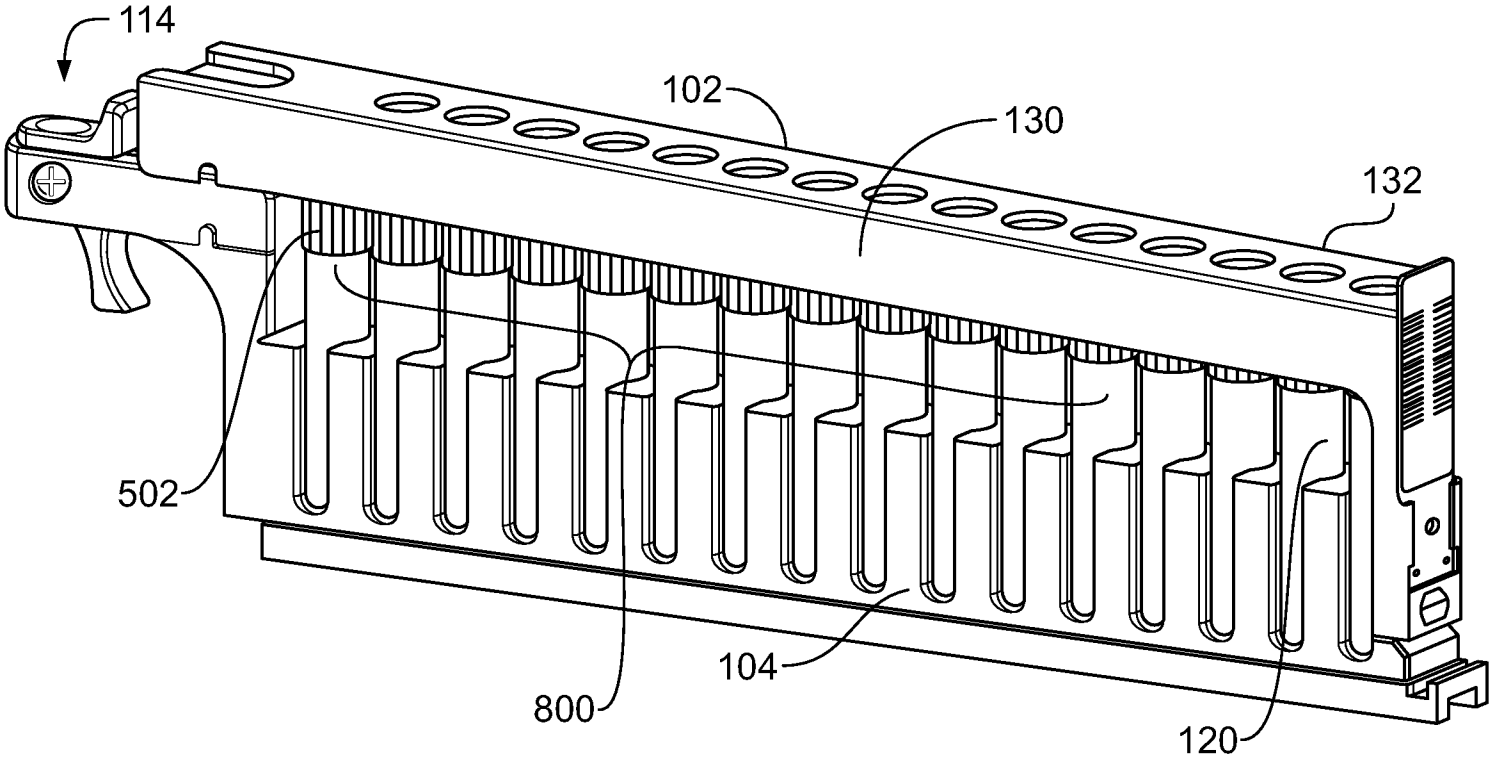
FIG. 8 shows the example sample tube rack of FIG. 1 with the retention bar not fully or properly engaged with or locked to the sample tube holder.

FIGS. 6-8 generally illustrate the mechanical interaction between the retention bar 102 and the sample tube holder 104. In particular, FIG. 6 shows the example sample tube rack 100 with the retention bar 102 removed. In FIG. 6, the sample tubes 120 have been loaded into respective ones of the apertures 118 of the sample tube holder 104. In this particular example, all of the apertures 118 have been loaded with a sample tube 120 and all of the sample tubes 120 are depicted as having the pierceable cap 502. However, in other example uses, one or more of the apertures 118 may not have a sample tube 120 loaded therein and one or more of the sample tubes 120 may not be capped (i.e., may be open).

FIG. 7 shows the example sample tube rack 100 with the retention bar 102 pivotally engaging the sample tube holder 104 via the leg 110 and, in particular, via the protrusion 106 and the opening 108. The pivoting action of the retention bar 102 is substantially devoid of any sliding action relative to the sample tube holder 104 as well as the tops of the sample tubes 120. The substantial elimination of any sliding action of the retention bar 102 relative to the sample tubes 120 further reduces the possibility of moving any biological material or other contaminates from the top of one of the sample tubes 120 to another one of the sample tubes 120.

FIG. 8 shows the example sample tube rack 100 of FIG. 1 with the retention bar 102 not fully or properly engaged with the sample tube holder 104. As can be clearly seen in FIG. 8, the configuration of the lateral portions 130 and 132 is such that when the retention bar 102 is not fully engaged with the latch mechanism 114 and, more generally, with the sample tube holder 104, one or more of the caps 502 (or tops if one or more caps are not present) of the sample tubes 120 are exposed as indicated at reference number 800. In this manner, the retention bar 102 is configured to provide a clear visual indication of whether the retention bar 102 is fully and/or properly secured, engaged and/or locked to the sample tube holder 104. Specifically, a skewed orientation (e.g., an angle) of the retention bar 102 relative to the sample tube holder 104 is plainly visible, particularly due to the varying exposure of the top portions of one or more of the sample tubes 120.

Figure 9:
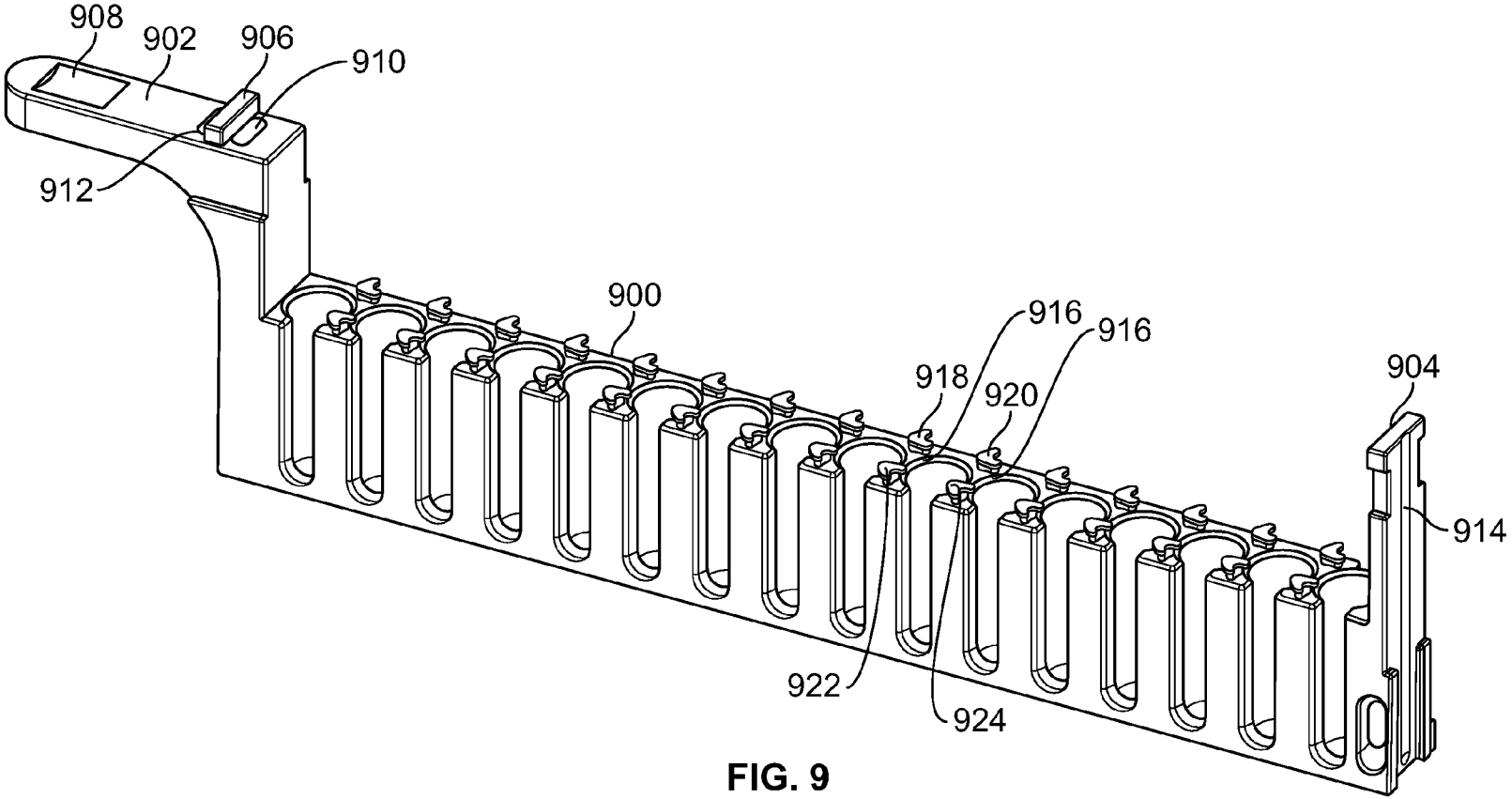
FIG. 9 illustrates another example sample tube holder.

FIG. 9 illustrates another example sample tube holder 900 that may be used to implement various sample tube racks having retention covers. The sample tube holder 900 is similar in principal to the sample tube holder 104 described above but employs different mechanisms to engage or lock a retention bar or cover. More specifically, the example sample tube holder 900 does not use a retention bar that pivots relative to the sample tube holder 900 as the retention bar is being secured or locked against the sample tube holder 900. Rather, sample tube holder 900 is configured to receive a retention bar by vertically placing the retention bar across a handle 902 at one end of the sample tube holder 900 and a post 904 at an opposite end of the sample tube holder 900 and then sliding the retention bar across the handle 902 and the post 904 to engage one or more features of the retention bar (e.g., a keyhole opening) with complementary features of the handle 902 and the post 904.

In the example of FIG. 9, the handle 902 includes a lug or key 906 that protrudes away from the handle 902, which may have a T-shaped profile. In addition, the handle 902 may include a depression 908, which facilitates gripping of the handle 902 by, for example, an operator's thumb or other finger(s). Still further, the handle 902 may include visual unlocked and locked indicators 910 and 912, respectively, which may be colored areas, textured areas, etc. that, as described in more detail below, can be used to indicate whether a retention bar is properly and/or fully engaged or locked to the sample tube holder 900. The post 904 also has a T-shaped portion 914, which is configured to lockably engage a retention bar.

Walls 916 of the sample tube holder 900 may include posts 918-924 that are configured to receive o-rings (not shown), for example, to facilitate stabilization of any sample tubes loaded in the rack 900. Such o-rings may be selected to frictionally engage outer surfaces of sample tubes to limit or prevent movement of the sample tubes once loaded in the sample tube rack 900.

Figure 10A:
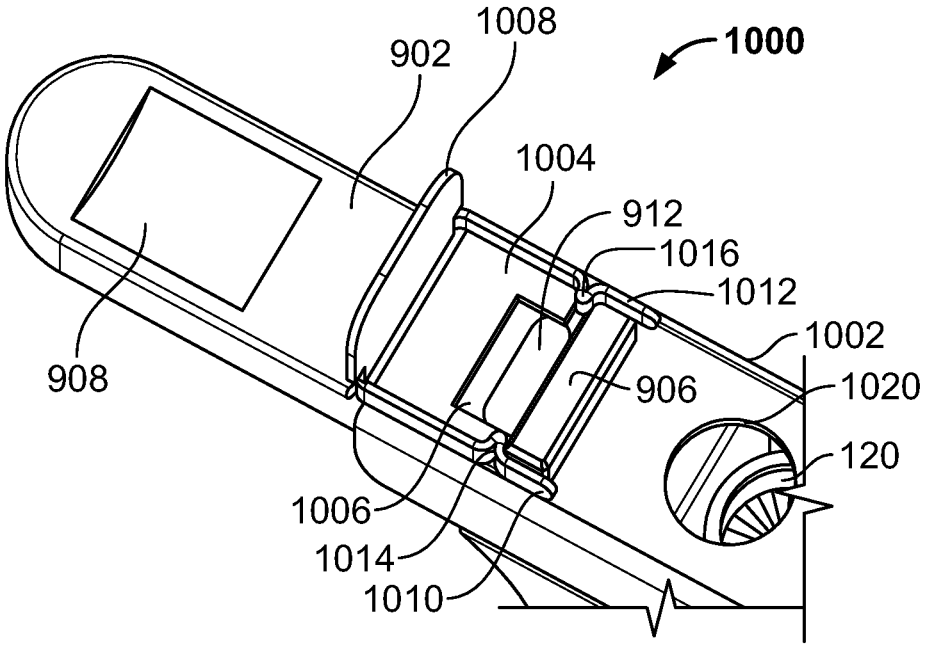
FIGS. 10A and 10B illustrate a latch mechanism that may be used to lock a retention bar to the example sample tube holder of FIG. 9.
Figure 10B:
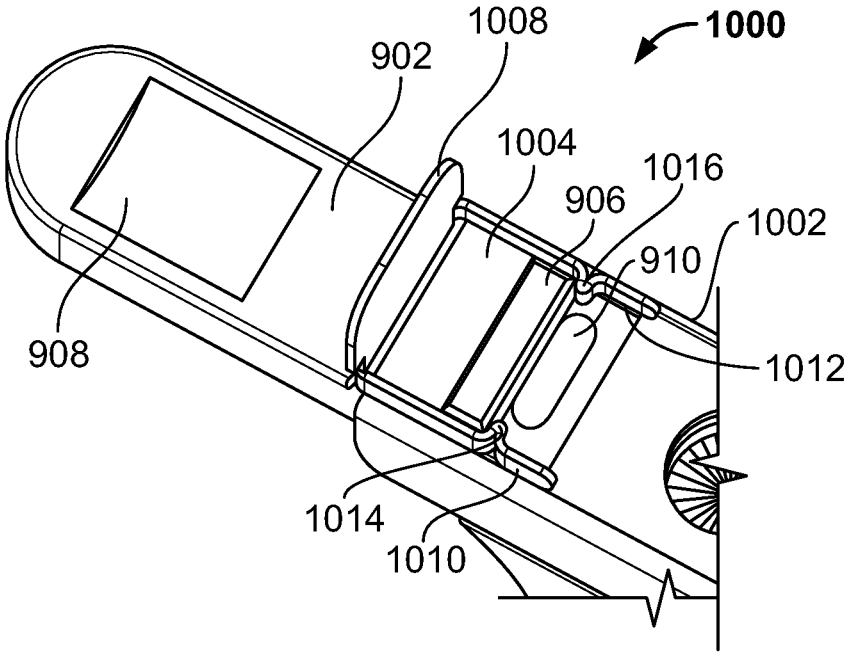

FIGS. 10A and 10B illustrate a latch mechanism 1000 that may be used to lock a retention bar 1002 to the example sample tube holder 900 of FIG. 9. As shown in FIGS. 10A and 10B, the retention bar 1002 includes a latch plate 1004 having an opening or keyhole 1006, an actuation handle or plate 1008, and bias members or fingers 1010 and 1012, where each of the fingers 1010 and 1012 includes a respective detent mechanism 1014 and 1016.

In FIG. 10A, the retention bar 1002 is shown in an unsecured condition in which the latch mechanism 1000 is not locked. This unlocked condition is clearly indicated by the exposure of the indicator 912 through the opening or keyhole 1006 in the latch plate 1004. To lock the latch 1000 and fully secure the retention bar 1002 to the sample tube holder 900, an operator may push the actuator plate 1008 in a direction away from the depression 908. As the lock plate 1004 is moved, the detent mechanisms 1014 and 1016 spread the fingers 1010 and 1012 away from the key 906 to allow the detent mechanisms 1014 and 1016 to pass over the key 906 and then springably return the fingers 1010 and 1012 to the locked state shown in FIG. 10B. The locked condition is clearly indicated by the presence of the indicator 910. In addition to using the lock indicators 910 and 912, an operator could, of course, also determine whether or not the retention bar 1002 is properly and/or fully engaged or locked by assessing whether or not apertures 1020 in the retention bar 1002 are aligned with the sample tubes 120 (see, e.g., FIG. 10A).

Figure 10C:
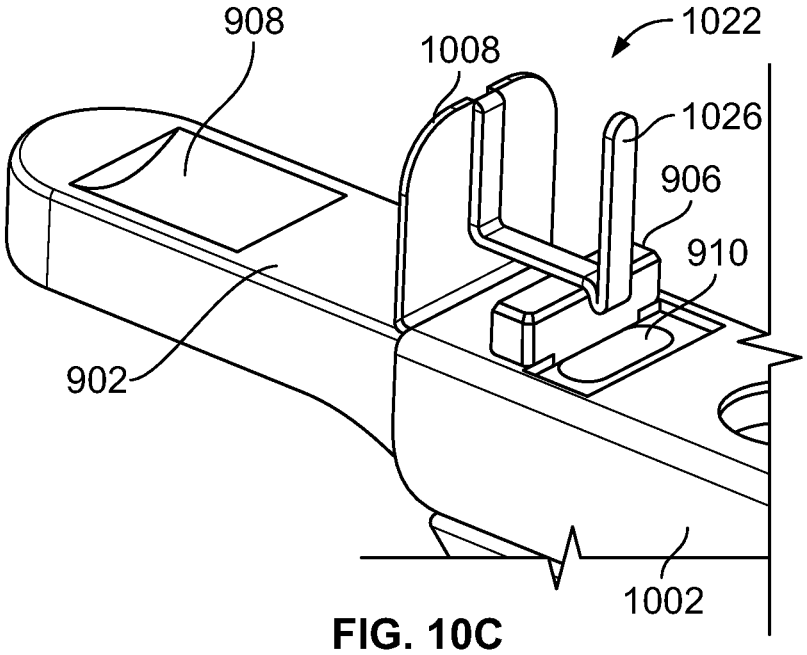
FIGS. 10C and 10D illustrate alternative latch mechanisms that may be used to lock a retention bar to the example sample tube holder of FIG. 9.
Figure 10D:
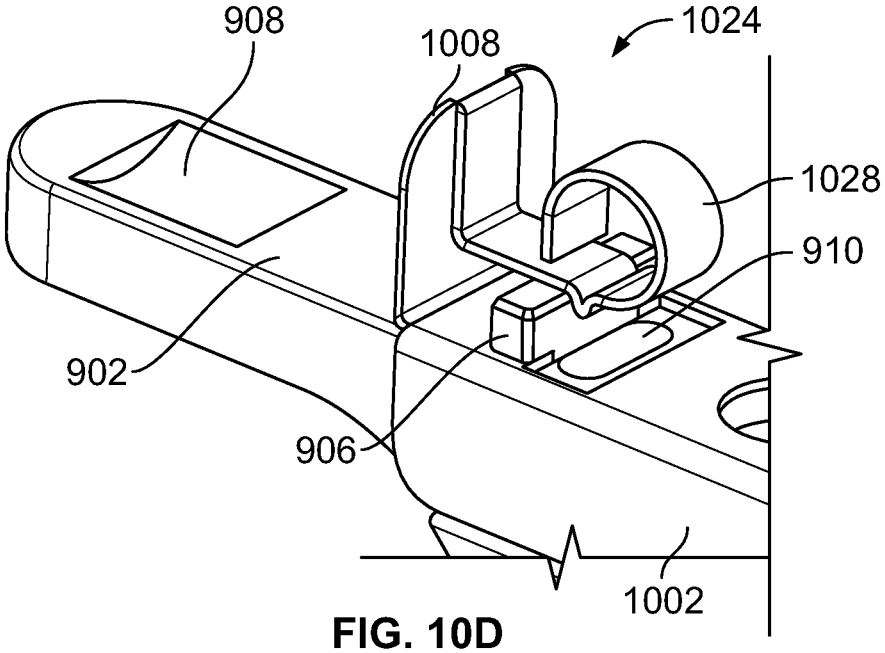

FIGS. 10C and 10D illustrate alternative latch mechanisms 1022 and 1024 that may be used to lock the example retention bar 1002 to the example sample tube holder 900 of FIG. 9. The alternative latch mechanisms 1022 and 1024 are similar to those of FIGS. 10A and 10B. However, the latch mechanisms 1022 and 1024 use alternative detent mechanisms 1026 and 1028, respectively. The detent mechanisms 1026 and 1028 are configured to travel over the top of the key or lug 906.

Figure 11:
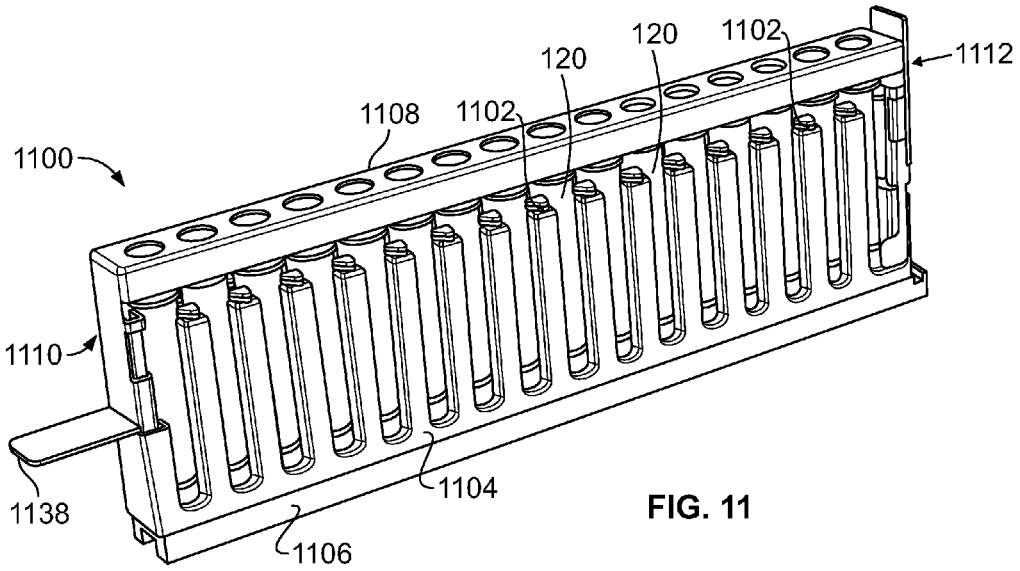
FIG. 11 illustrates another example sample tube rack having o-rings to stabilize sample tubes.
Figure 13:
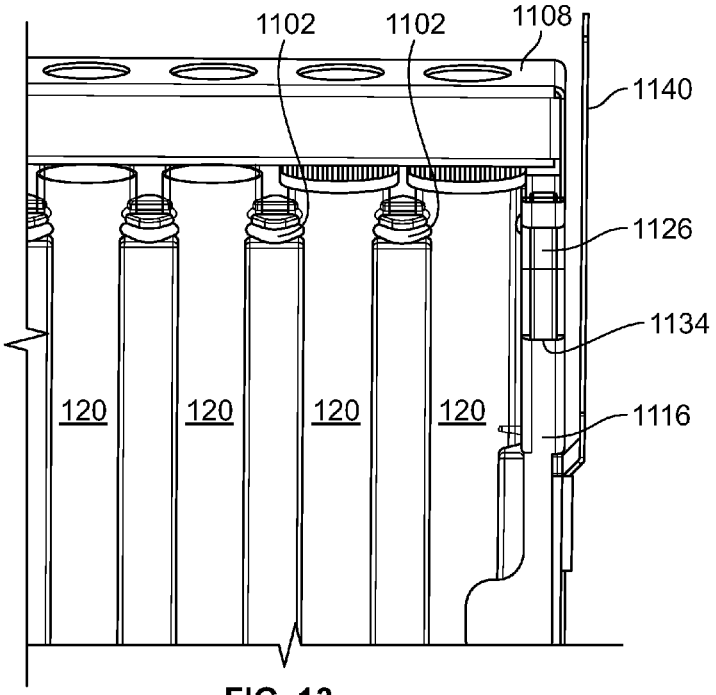
FIG. 13 is an enlarged partial view of the sample tube rack of FIG. 11 showing the o-rings stabilizing sample tubes with caps and sample tubes without caps.
Figure 12:
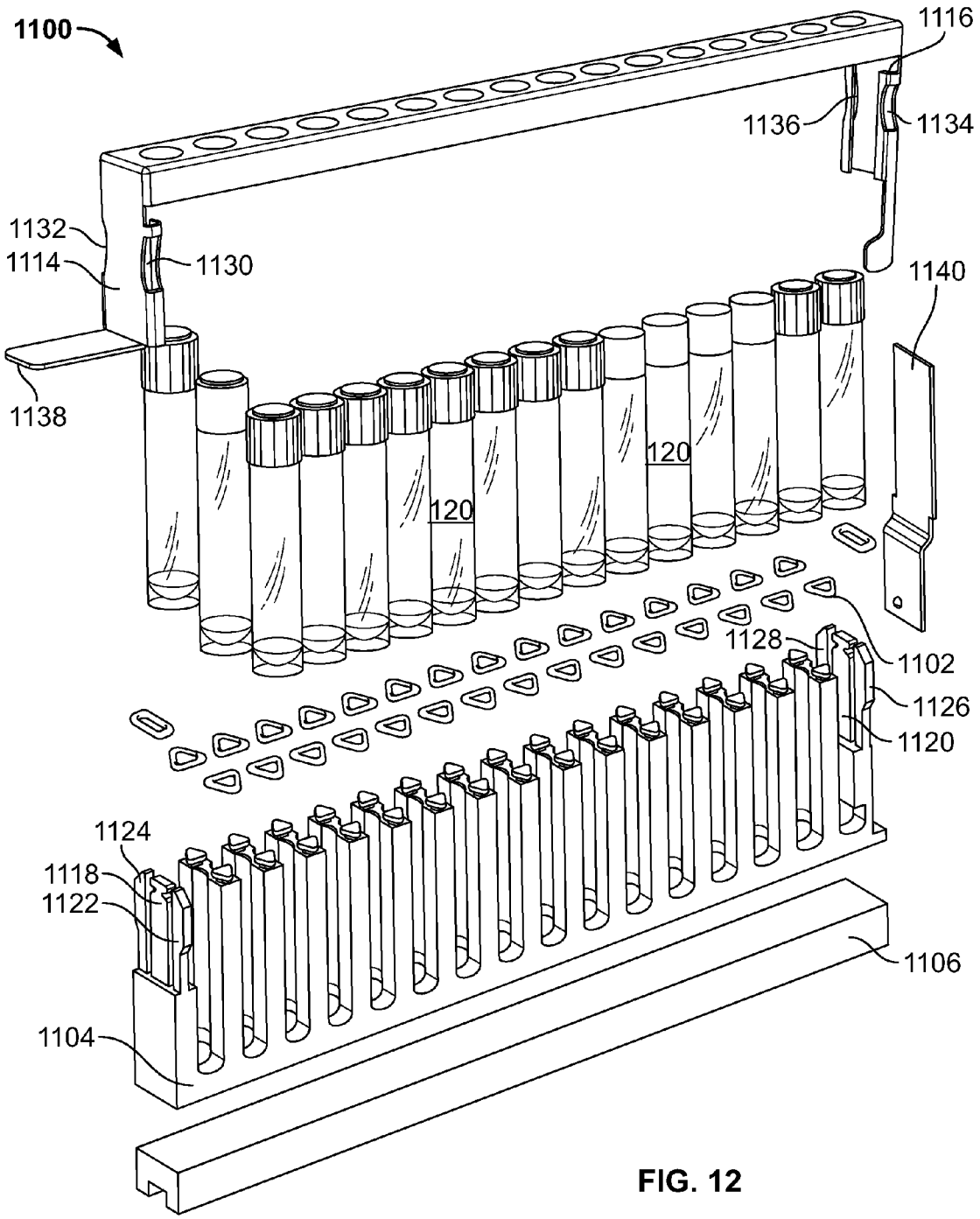
FIG. 12 is an exploded view of the sample tube rack of FIG. 11.

FIG. 11 illustrates another example sample tube rack 1100 having o-rings 1102 to stabilize the sample tubes 120. FIG. 12 is an exploded view of the sample tube rack 1100 of FIG. 11, and FIG. 13 is an enlarged partial view of the sample tube rack 1100 of FIG. 11 showing the o-rings 1102 stabilizing the sample tubes 120 with caps and sample tubes 120 without caps. Referring to FIGS. 11-13, the example sample tube rack 1100 includes a sample tube holder or carrier 1104, a guide rail 1106 and a retention cover or bar 1108.

The retention bar 1108 may be vertically coupled or locked to the sample tube holder 1104 via buckle structures 1110 and 1112, which are located at opposite ends of the sample tube rack 1100. As can be most clearly seen in FIG. 12, each of the buckles 1110 and 1112 includes a respective female buckle portion 1114, 1116 and male buckle portion 1118, 1120 that may be pushed together to lock the retention bar 1108 to the sample tube holder 1104. The male buckle portions 1118 and 1120 include tangs or fingers 1122-1128 that form a snap-fit coupling with openings 1130-1136. To remove the retention bar 1108 from the sample tube holder 1104, an operator presses the fingers 1122-1128 inwardly (i.e., toward a longitudinal axis of the sample tube rack 1100) and pulls upwardly on the retention bar 1108 to lift the retention bar 1108 away from the sample tube holder 1104. The locking and removal of the retention bar 1108 may be facilitated by use of a handle or lift tab 1138. Additionally, the example sample tube rack 1100 may include a tag 1140 on which identifying indicia or information may be placed for use during processing of the sample tube contents.

Figure 14:
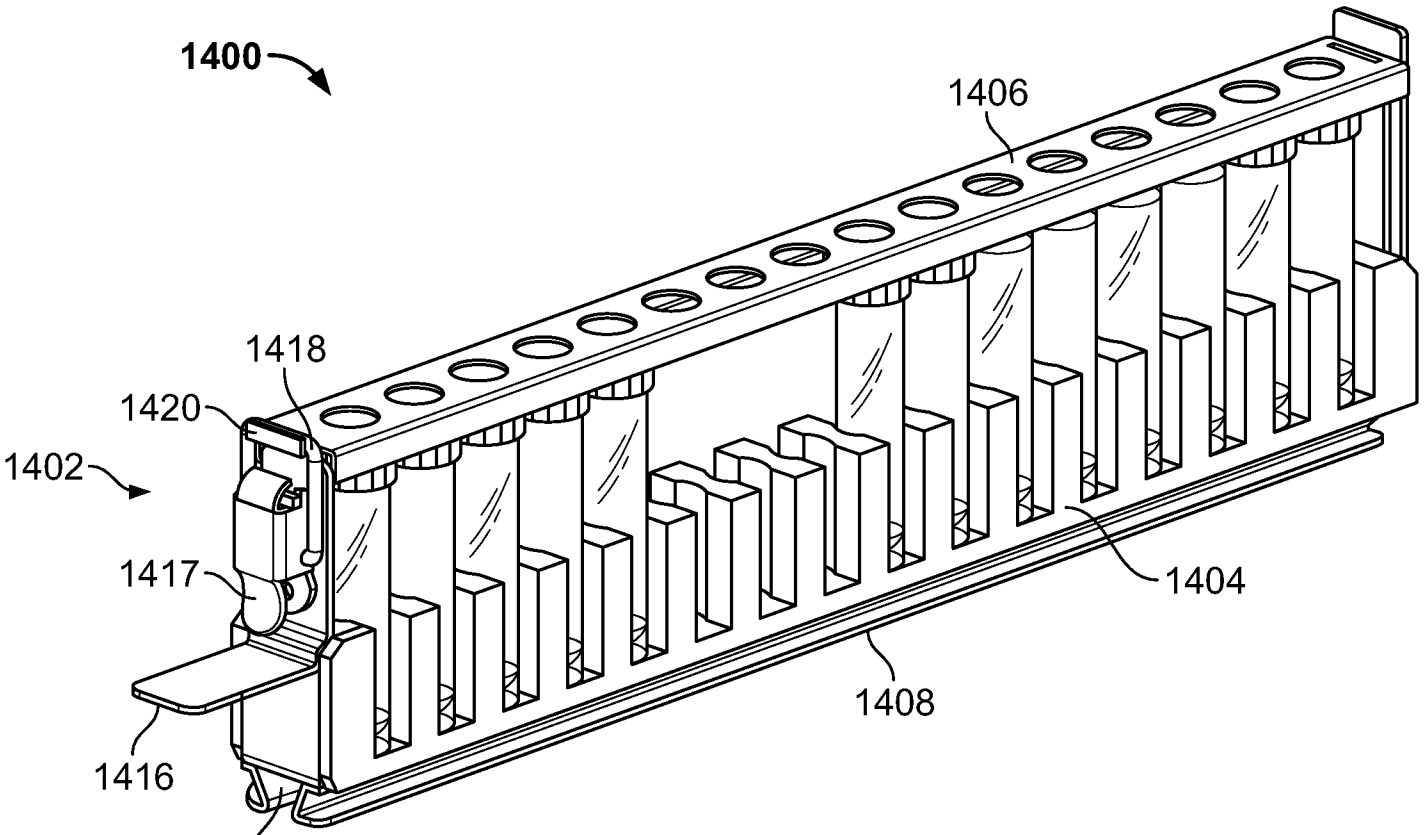
FIG. 14 illustrates another example sample tube rack having a buckle-type latch mechanism.
Figure 15:
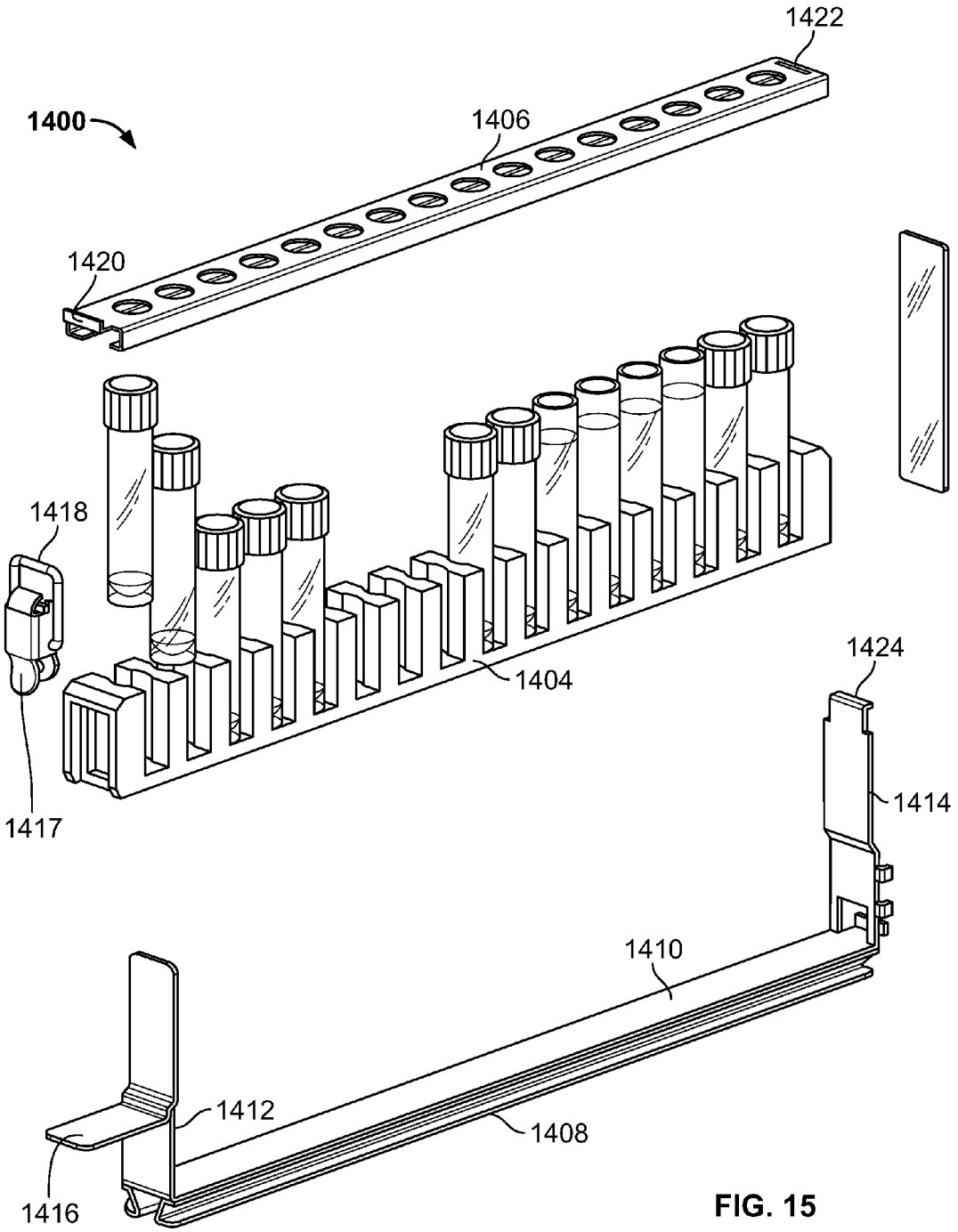
FIG. 15 is an exploded view of the sample tube rack of FIG. 14.

FIG. 14 illustrates another example sample tube rack 1400 having a buckle-type latch mechanism 1402. FIG. 15 is an exploded view of the sample tube rack 1400 of FIG. 14. With reference to FIGS. 14 and 15, the example sample tube rack 1400 includes a sample tube holder 1404, a retention bar 1406, and a frame assembly 1408. The frame assembly 1408 includes a guide rail portion 1410 and end plates 1412 and 1414. One of the end plates 1412 also includes a handle or tab 1416 to facilitate handling of the rack 1400 during, for example, loading of the sample tubes and/or securing or locking of the retention bar 1406.

The latch mechanism 1402 includes a buckle lever 1417 and a loop or hasp 1418 that engages and pulls downwardly on a lip 1420 of the retention bar 1406 to the lock the retention bar to the rack 1400. At the end of the rack 1400 opposite the latch 1402, the retention bar 1406 includes a slot 1422 to receive a hooked end 1424 of the end plate 1414.

Figure 16A:
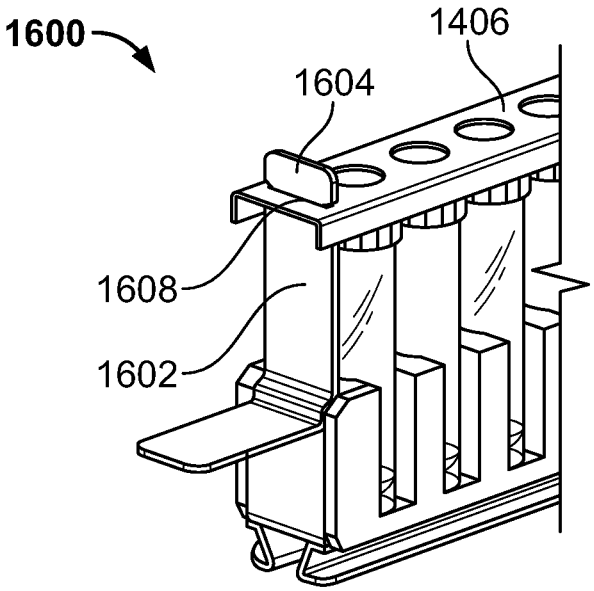
FIGS. 16A and 16B depict an alternative latch that may be used with the example sample tube rack of FIG. 14.
Figure 16B:
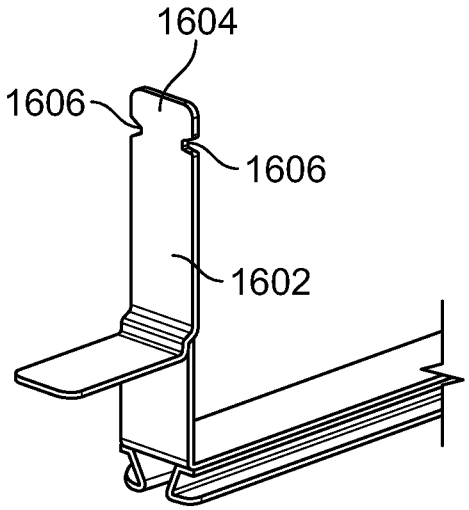

FIGS. 16A and 16B depict an alternative latch mechanism 1600 that may be used with the example sample tube rack 1400 of FIG. 14. The example latch mechanism 1600 uses an end plate 1602 having an end 1604 with notches 1606 that provide a snap-fit arrangement with an opening or slot 1608 in the retention bar 1406. In this manner, securing or locking the retention bar 1406 to the rack assembly 1400 is performed by pushing the retention bar 1400 vertically onto the end plate 1602. Alternatively, removing the retention bar 1400 involves pulling the retention bar 1406 away from the end plate 1602 with sufficient force to cause the edges of the opening or slot 1608 to pull out of the notches 1606 to allow the end 1604 of the plate 1602 to be pulled out of the retention bar 1406.

Figure 17:
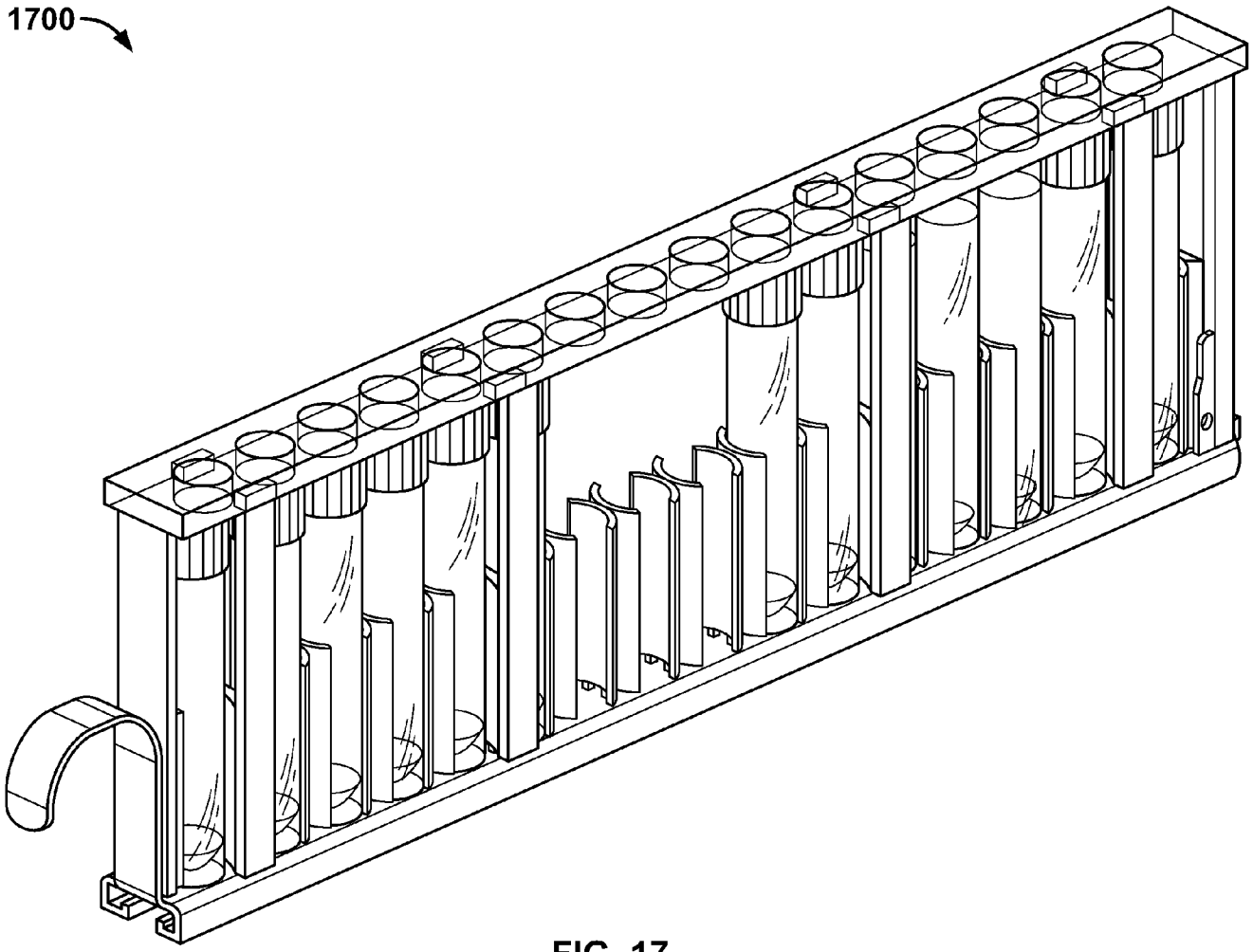
FIG. 17 illustrates another example sample tube rack.
Figure 18:
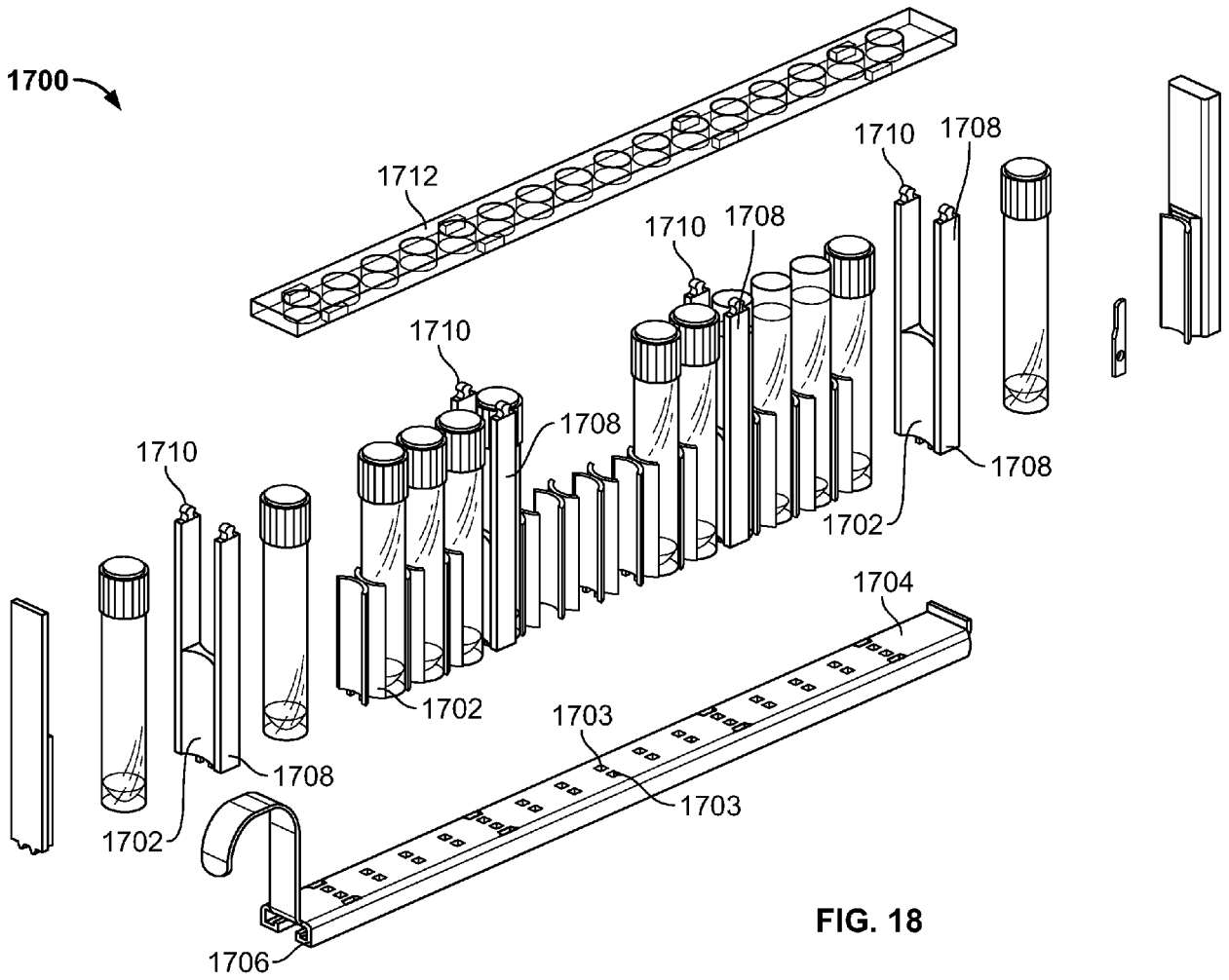
FIG. 18 is an exploded view of the example sample tube rack of FIG. 17.

FIG. 17 illustrates another example sample tube rack 1700 and FIG. 18 is an exploded view of the example sample tube rack 1700 of FIG. 17. The example sample tube rack 1700 employs a modular construction in which wall sections 1702 may be snap-fit or otherwise plugged into openings 1703 of a base 1704, which has an integral rail feature 1706. Some of the wall sections 1702 may include posts 1708 having ends 1710 that plug or snap-fit into respective openings or slots in a retention cover or bar 1712.

Figure 19:
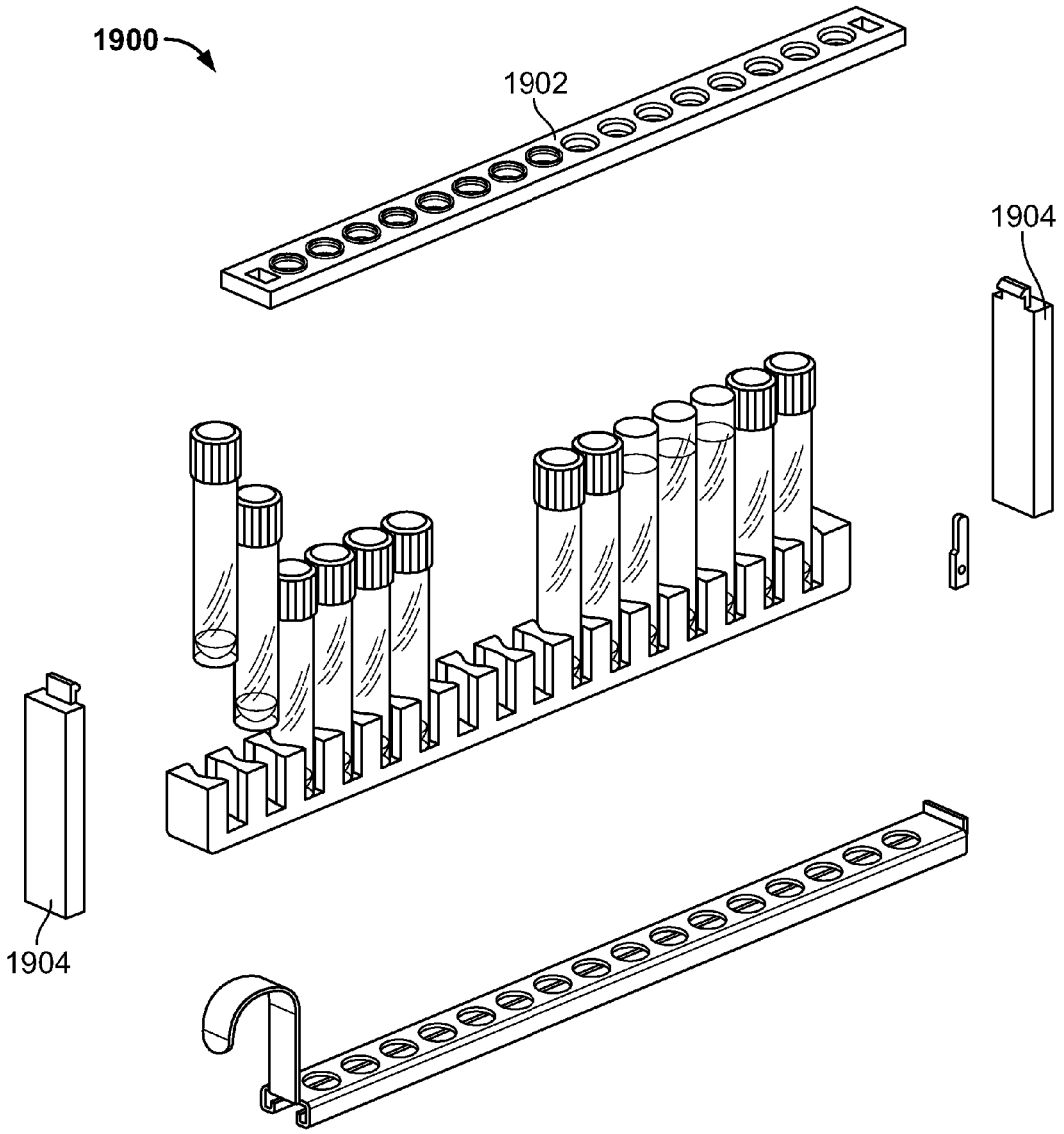
FIG. 19 illustrates an exploded view of another sample tube rack.

FIG. 19 illustrates an exploded view of another sample tube rack 1900. The example sample tube rack 1900 employs a retention bar 1902 that plugs or snap-fits onto end wall sections 1904.

Figure 21:
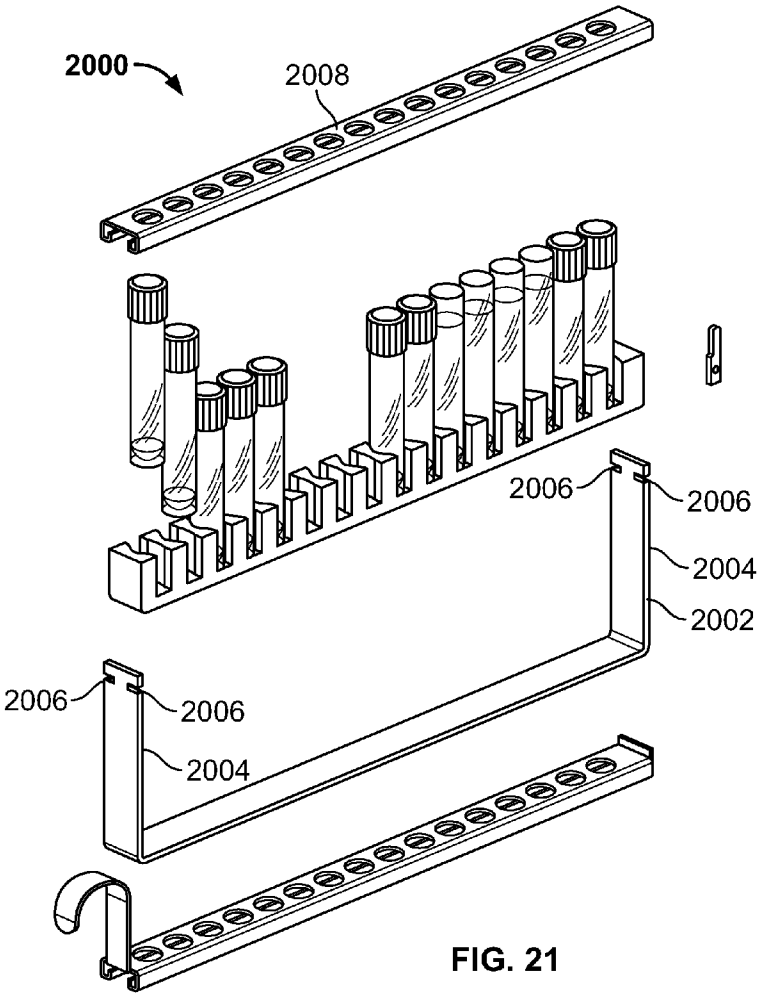
FIG. 21 is an exploded view of the example sample tube rack of FIG. 20.
Figure 20:
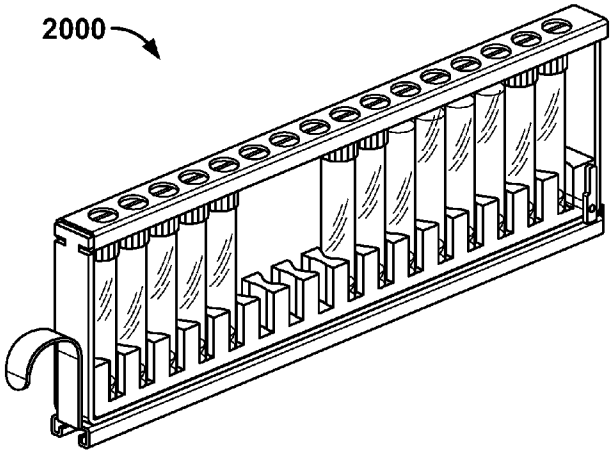
FIG. 20 illustrates yet another example sample tube rack.

FIG. 20 illustrates yet another example sample tube rack 2000, and FIG. 21 is an exploded view of the example sample tube rack 2000 of FIG. 20. The example rack 2000 of FIGS. 20 and 21 includes a u-shaped structure 2002 having upright legs 2004 with slots 2006 to slidably receive a retention bar 2008.

Figure 22:
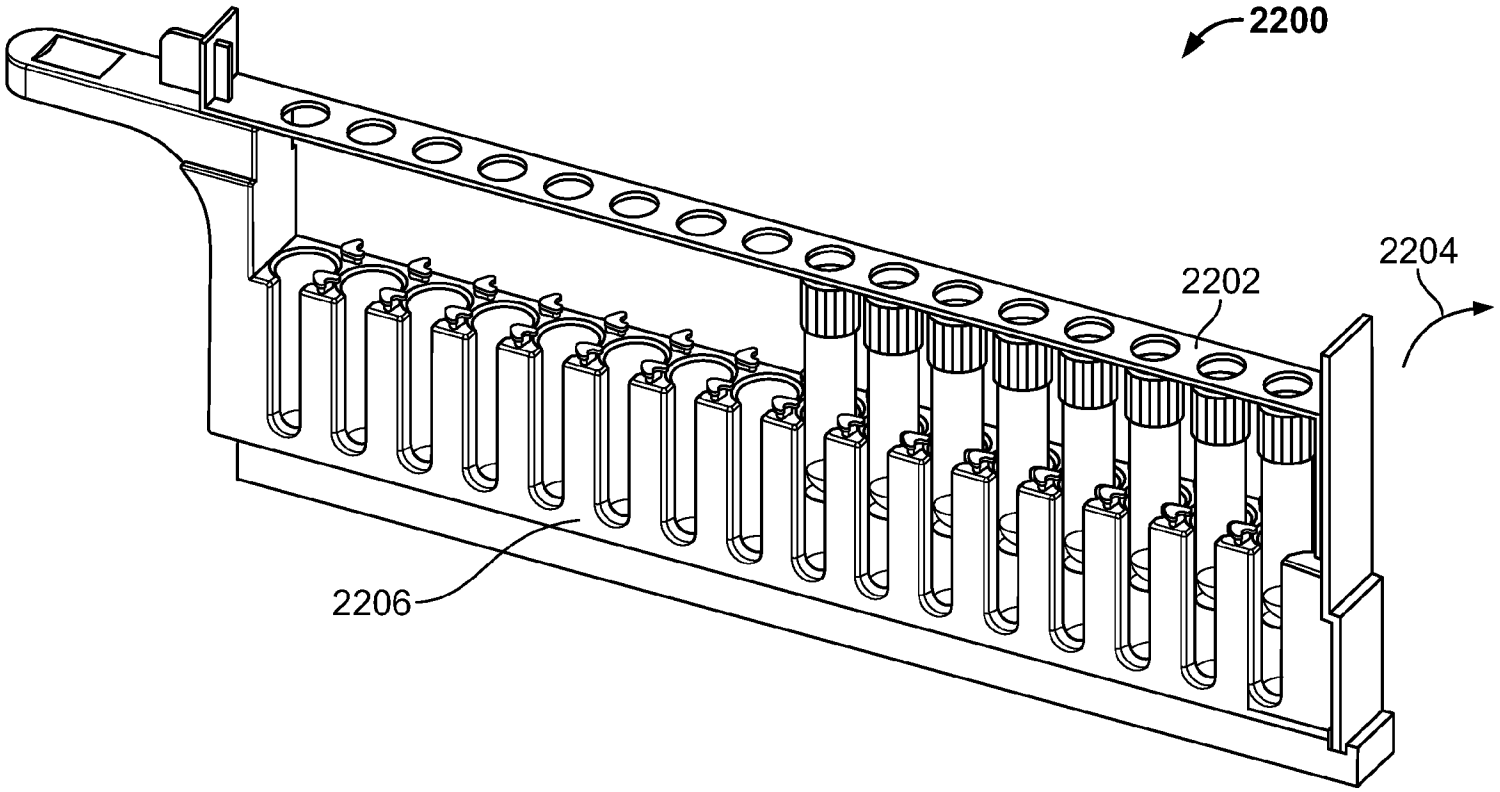
FIG. 22 illustrates an example sample tube rack having a retention bar that pivots laterally relative to the sample tube holder portion of the rack.

FIG. 22 illustrates an example sample tube rack 2200 having a retention bar 2202 that pivots laterally relative (e.g., along the direction of arrow 2204) to a sample tube holder portion 2206 of the rack 2200.

Figure 23:
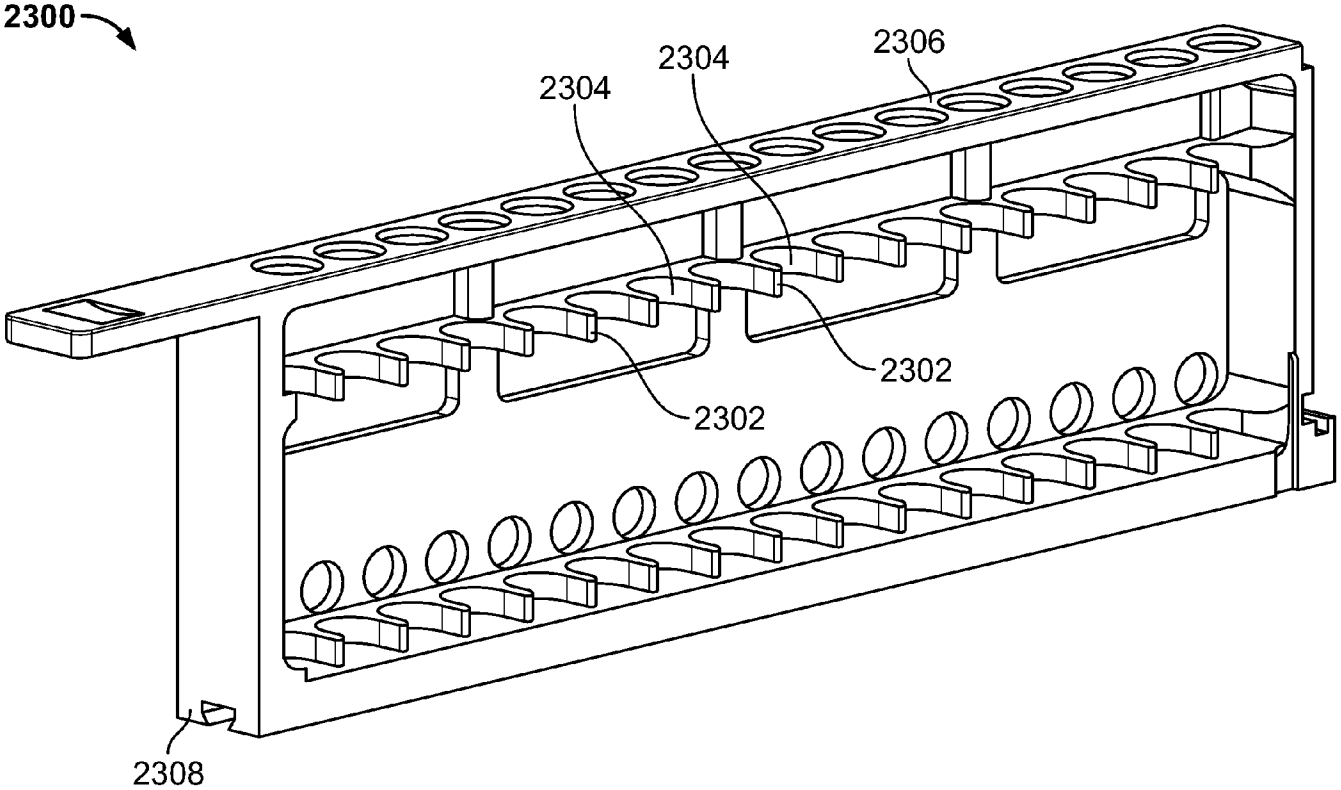
FIG. 23 illustrates an example one-piece sample tube rack in which sample tubes are side-loaded.

FIG. 23 illustrates an example one-piece sample tube rack 2300 in which sample tubes are side-loaded. The example sample tube rack 2300 includes a plurality of fingers or grips 2302 that are spaced apart (at least at the ends of the fingers or grips 2302) to be a distance apart that is smaller than, for example, the diameter of the sample tubes. In this manner, the sample tubes can be captured by the fingers or grips 2302 by pushing the tubes to spread the fingers or grips 2302 and into holding apertures 2304, which may be sized to be somewhat larger than the diameter of the tubes. Removing sample tubes involves an operator pulling the tubes away from the rack 2300 back through the fingers or grips 2302.

The one-piece configuration shown in FIG. 23 may be molded from a plastic material to maintain lower costs, facilitate cleaning of the rack 2300 and/or to reduce the weight of the rack 2300. However, one or more features of the rack 2300 may instead be separately created and attached via any fastening mechanism. For example an integral retention bar 2306 and/or an integral guide rail 2308 could instead be separate pieces that are attached to the rack 2300.

Although certain methods and apparatus have been described herein, the scope of coverage of this patent is not limited thereto. To the contrary, this patent covers all methods and apparatus fairly falling within the scope of the appended claims either literally or under the doctrine of equivalents.

What is claimed is:

1. A rack for holding sample tubes, comprising:

a tube holder to hold the sample tubes in a substantially vertical orientation; and a retention cover removably coupled to the tube holder via a hinge, the retention cover to pivotally engage the tube holder at a first end and to lock against the tube holder at a second end opposite the first end, the second end of the retention cover to pivot relative to the tube holder about an axis that is non-parallel relative to a longitudinal axis of the retention cover while the first end of the retention cover is pivotally captured by the tube holder.

2. The rack of claim 1, wherein the retention cover has a first end and a second end opposite the first end, wherein the first end of the retention cover includes a leg depending from an upper surface of the retention cover and the second end of the retention cover includes a latch.

3. The rack of claim 2, wherein the tube holder has a first end and a second end opposite the first end, the first end of the tube holder including a projection and the second end of the tube holder including a recess, wherein the leg of the retention cover includes an opening to receive the projection of the tube holder to pivotally capture the retention cover to the tube holder, the leg and the projection defining the hinge.

4. The rack of claim 3, wherein the recess of the tube holder is to receive the latch of the retention cover when the retention cover is coupled to the tube holder.

5. The rack of claim 3, wherein the tube holder includes a handle adjacent a first end of the tube holder, the handle defining the recess.

6. A rack for holding sample tubes, comprising:

a sample tube carrier having a first end and a second end opposite the first end; and a retention bar having a first end and a second end opposite the first end, the retention bar to be removably coupled to the sample tube carrier such that the first end of the retention bar is to align with the first end of the sample tube carrier and the second end of the retention bar is to align with the second end of the sample tube carrier, the first end of the retention bar to pivotally couple to the first end of the sample tube carrier to define a hinged joint, the second end of the retention bar to couple to the sample tube carrier by rotating the second end of the retention bar relative to the first end of the retention bar while the first end of the retention bar is pivotally captured by the sample tube carrier via the hinged joint, the retention bar to interface with a machine.

7. The rack of claim 6, wherein the second end of the sample tube carrier and the second end of the retention bar define a retainer to couple the retention bar and the sample tube carrier when the second end of the retention bar is in engagement with the second end of the sample tube carrier.

8. The rack of claim 7, wherein the retainer includes a recess defined in the sample tube carrier and a protrusion extending from the second end of the retention bar, the recess to receive the protrusion when the retention bar is coupled to the sample tube carrier.

9. The rack of claim 7, wherein the retention bar includes a leg.

10. The rack of claim 9, wherein the leg is to project toward the sample tube carrier when the retention bar is coupled to the sample tube carrier, wherein the leg protrudes downwardly toward the sample tube carrier.

11. The rack of claim 9, wherein the sample tube carrier includes a tab to engage an opening of the leg to pivotally capture the retention bar and the sample tube carrier.

12. The rack of claim 11, wherein the tab forms a shoulder between the tab and lower surface of the sample tube carrier, the shoulder to be engaged by the retention bar when the retention bar is coupled to the sample tube carrier.

13. A rack for holding sample tubes, comprising:

a sample tube carrier having a first end that includes one of a protrusion or a slot; and an elongated retention bar to be coupled to the sample tube carrier, the retention bar includes an elongated body having a first end and a second opposite the first end, the first end of the retention bar includes the other one of the protrusion or the slot, the protrusion and the slot to define a hinge when the first end of the retention bar is coupled to the first end of the sample tube carrier, the hinge to enable a second end of the retention bar to couple to the sample tube carrier by rotating the second end of the retention bar relative to the first end of the retention bar while the first end of the retention bar is pivotally hinged with the sample tube carrier via engagement between the protrusion and the slot.

14. The rack of claim 13, wherein a second end of the sample tube carrier opposite the first end includes a handle, and wherein the first end of the sample tube carrier does not include a handle.

15. The rack of claim 13, wherein the second end of the retention bar includes at least one of a latch or a recess.

16. The rack of claim 15, wherein the second end of the sample tube carrier includes the other one of the latch or the recess, wherein the latch is to engage the recess to hold the retention bar with the sample tube carrier when the retention bar is coupled to the sample tube carrier.

17. The rack of claim 2, wherein the retention cover is pivotally captured by the tube holder via a hinge, wherein the hinge aligns with the longitudinal axis of the retention cover.

18. The rack of claim 6, wherein a plane taken along a longitudinal axis of the retention bar bifurcates the hinged joint.

* * * * *